US009677024B2

(12) United States Patent
Esche et al.

(10) Patent No.: US 9,677,024 B2
(45) Date of Patent: Jun. 13, 2017

(54) FUEL EFFICIENT LUBRICATING OILS

(71) Applicant: VANDERBILT CHEMICALS, LLC, Norwalk, CT (US)

(72) Inventors: Carl K. Esche, Richmond, VA (US); Glenn A. Mazzamaro, Middlebury, CT (US); Thorsten Bartels, Weisenheim (DE); David B. Gray, Chalfont, PA (US)

(73) Assignee: VANDERBILT CHEMICALS, LLC, Norwalk, CT (US)

( * ) Notice: Subject to any disclaimer, the term of this patent is extended or adjusted under 35 U.S.C. 154(b) by 0 days.

(21) Appl. No.: 14/405,550

(22) PCT Filed: Jun. 5, 2013

(86) PCT No.: PCT/EP2013/061529
§ 371 (c)(1),
(2) Date: Dec. 4, 2014

(87) PCT Pub. No.: WO2013/182581
PCT Pub. Date: Dec. 12, 2013

(65) Prior Publication Data

US 2015/0133352 A1 May 14, 2015

Related U.S. Application Data

(60) Provisional application No. 61/656,111, filed on Jun. 6, 2012.

(30) Foreign Application Priority Data

Jun. 8, 2012 (EP) ..... 12171229

(51) Int. Cl.
*C10M 161/00* (2006.01)
*C10M 107/00* (2006.01)
(Continued)

(52) U.S. Cl.
CPC ..... *C10M 161/00* (2013.01); *C10M 107/00* (2013.01); *C10M 149/10* (2013.01); *C10M 2201/06* (2013.01); *C10M 2203/1025* (2013.01); *C10M 2205/04* (2013.01); *C10M 2207/144* (2013.01); *C10M 2207/289* (2013.01); *C10M 2209/084* (2013.01); *C10M 2209/086* (2013.01); *C10M 2215/064* (2013.01); *C10M 2215/223* (2013.01); *C10M 2215/28* (2013.01); *C10M 2217/02* (2013.01); *C10M 2217/024* (2013.01); *C10M 2217/028* (2013.01); *C10M 2219/046* (2013.01); *C10M 2219/066* (2013.01); *C10M 2219/068* (2013.01); *C10M 2223/045* (2013.01); *C10M 2227/066* (2013.01); *C10N 2210/06* (2013.01); *C10N 2230/02* (2013.01); *C10N 2230/04* (2013.01); *C10N 2230/08* (2013.01); *C10N 2230/10* (2013.01); *C10N 2230/54* (2013.01); *C10N 2230/68* (2013.01); *C10N 2240/10* (2013.01)

(58) Field of Classification Search
CPC ..... C10M 2223/045; C10M 107/00; C10M 141/10; C10M 161/00; C10M 2203/1025; C10M 2205/04; C10M 2207/144; C10M 2207/289; C10M 2209/084; C10M 2209/086; C10M 2215/064; C10M 2215/223; C10M 2215/28; C10M 2217/02; C10M 2217/024; C10M 2217/028; C10M 2219/046; C10M 2219/066; C10M 2219/068; C10M 2227/066
USPC ..... 508/294, 469, 168, 369
See application file for complete search history.

(56) References Cited

U.S. PATENT DOCUMENTS 4,889,647 A * 12/1989 Rowan ..... C07F 11/005 508/367
6,258,761 B1 7/2001 Lange et al.
(Continued)

FOREIGN PATENT DOCUMENTS

GB 1 068 283 A 5/1967
GB EP 1006173 A1 * 6/2000 ..... C10M 141/10
(Continued)

OTHER PUBLICATIONS

International Search Report dated Jul. 19, 2013, mailed Jul. 30, 2013.
(Continued)

*Primary Examiner* — James Goloboy
(74) *Attorney, Agent, or Firm* — Norris McLaughlin & Marcus P.A.

(57) ABSTRACT

The present invention relates to an engine oil lubricant composition for use in internal combustion engines comprising one or more molybdenum containing compounds that deliver 1-1000 ppm molybdenum to the finished oil, one or more phosphorus containing compounds that deliver 25-650 ppm phosphorus to the finished oil, and one or more poly(meth)acrylate viscosity index improvers (VI improvers) that may or may not be functionalized, for improved fuel economy and turbocharger related deposits. In addition, the composition comprises an antioxidant system which is carefully balanced to provide improved fuel economy, comprising an aminic antioxidant, a phenolic antioxidant and an ashless dithiocarbamate. Additionally, the formulated oil may contain a dispersant poly(meth)acrylate, in addition to the PAMA VI improver, to reduce the amount of traditional succinimide dispersants.

11 Claims, No Drawings

(51) Int. Cl.
*C10M 149/10* (2006.01)
*C10M 159/18* (2006.01)

(56) References Cited

U.S. PATENT DOCUMENTS

| | | | | |
|---|---|---|---|---|
| 6,323,164 | B1 | 11/2001 | Liesen et al. | |
| 2006/0223724 | A1 | 10/2006 | Gatto et al. | |
| 2007/0213237 | A1 | 9/2007 | Scherer et al. | |
| 2008/0305972 | A1* | 12/2008 | Devlin | C10M 101/02 508/421 |
| 2010/0009875 | A1* | 1/2010 | Dong | C10M 141/08 508/202 |
| 2011/0237474 | A1 | 9/2011 | Mazzamaro et al. | |
| 2012/0135902 | A1 | 5/2012 | Baum et al. | |

FOREIGN PATENT DOCUMENTS

| | | | |
|---|---|---|---|
| JP | 2003502479 | A | 1/2003 |
| JP | 200616453 | A | 1/2006 |
| JP | 2007197509 | A | 8/2007 |
| WO | 9717417 | A1 | 5/1997 |
| WO | 2010141528 | A1 | 12/2010 |

OTHER PUBLICATIONS

Japanese Office Action and English translation of Office Action for corresponding application JP 2015-515504 dated Jan. 23, 2017.

* cited by examiner

FUEL EFFICIENT LUBRICATING OILS

This application is a 371 application of PCT/EP2013/061529 filed Jun. 5, 2013, which claims foreign priority benefit under 35 U.S.C. §119 of European application 12171229.3 filed Jun. 8, 2012 and U.S. Provisional Application No. 61/656,111, filed Jun. 6, 2012.

The present invention relates to an engine oil lubricant composition for use in internal combustion engines comprising one or more molybdenum containing compounds that deliver 1-1000 ppm molybdenum to the finished oil, one or more phosphorus containing compounds that deliver 25-650 ppm phosphorus to the finished oil, and one or more poly(meth)acrylate (PAMA) viscosity index improvers (VI improvers) that may or may not be functionalized, for improved fuel economy and turbocharger related deposits. In addition, the composition comprises an antioxidant system which is carefully balanced to provide improved fuel economy, comprising an aminic antioxidant, a phenolic antioxidant and an ashless dithiocarbamate. Additionally, the formulated oil may contain a dispersant poly(meth) acrylate, in addition to the PAMA VI improver, to reduce the amount of traditional succinimide dispersants.

Introduction

Global economic and pollution concerns are having a major impact on how modern engine oils are being formulated. Governments around the world are issuing new regulations requiring higher fuel economy for passenger car and commercial vehicles. Modern engine oil must also meet new specifications requiring reduced levels of phosphorus and sulfur to protect the efficacy of pollution control devices. In addition to global pollution concerns, modern engine oils must also be more fuel efficient than earlier generations to reduce the impact of high priced gasoline and diesel fuel to the consumer. At the same time, oxidation, wear and corrosion performance of the oil must not be compromised.

Engine oils are formulated with antioxidants, friction modifiers, dispersants and antiwear additives to improve vehicle fuel economy, cleanliness and wear. Unfortunately, many of these additives contribute to the fouling of the pollution control devices. When this occurs, vehicles emit high levels of pollution because of the failing performance of the pollution control device.

It is common knowledge that high levels of phosphorus, sulfur and ash in gasoline and diesel engine oils can negatively affect the performance of pollution control devices. Not only is the level of phosphorus in engine oil important for the proper performance of pollution control devices but also phosphorus volatility. Phosphorus volatility can have a significant negative impact on the performance of pollution control devices. For example, phosphorus compounds with a high level of phosphorus volatility will have a greater impact on the performance of vehicle pollution control devices than phosphorus compounds with a low level of phosphorus volatility. New gasoline and diesel engine oil specifications require engine oils to contain low levels of phosphorus, sulfur and ash to protect the pollution control devices. Unfortunately, the antiwear additives used in engine oils to protect the engine contain phosphorus and sulfur. To ensure proper wear protection for gasoline powered engines and the pollution control equipment, GF-5, the most recent engine oil specification for gasoline powered vehicles, specifies a phosphorus range of 600 ppm and 800 ppm and phosphorus volatility retention of at least 79% minimum.

Molybdenum additives are well known to those skilled in the art of oil formulation to function as friction modifiers to lower engine friction and promote fuel economy. However, too high a level of molybdenum can cause corrosion and deposits which can lead to excess wear and a shorten engine life.

It is also well known by the industry that engine oil formulated with a low High Temperature High Shear (HTHS) viscosity promote good fuel economy because of the resultant thinner oil film. However, engines lubricated by thin oil films are prone to excessive wear that shortens engine life. Thus another aspect of the present invention is to formulate a finished oil that contains poly(meth)acrylate VI improver for thin film formation for improved fuel economy and also good wear protection.

To meet the new tougher fuel economy regulations, Original Equipment Manufacturers (OEMs) are building smaller engines equipped with turbochargers. Because turbochargers operate at high temperatures, it is well known in the industry that turbochargers promote coking related deposit formation. Therefore, another aspect of this invention is improved high temperature turbocharger related deposit control for high molybdenum containing oils.

To address these global concerns, a unique oil formulation approach was used to formulate a pollution catalyst friendly highly fuel efficient engine oil. The fully formulated oil contains a dispersant PAMA VI improver, high molybdenum level for improved fuel economy and low phosphorus for good catalyst compatibility.

Furthermore, the formulated oil contains an antioxidant system which is carefully balanced to provide improved fuel economy, comprising an aminic antioxidant, a phenolic antioxidant and an ashless dithiocarbamate. Additionally, the formulated oil may contain a dispersant poly(meth) acrylate, in addition to the PAMA VI improver, to reduce the amount of traditional succinimide dispersants.

Advantageous properties with regard to soot dispersion (piston cleanliness), wear protection and friction modification in motor oils can be established in conventional PAMA chemistry by grafting N-vinyl compounds (usually N-vinylpyrrolidone) onto PAMA base polymers (DE 1 520 696 to Röhm and Haas and WO 2006/007934 to RohMax Additives).

The approaches detailed above lead to a reduction in the fuel consumption. However, there is still the permanent desire to further improve fuel consumption.

It is an object of the present invention to provide better fuel economy at low, regular and/or high temperature.

It is a further object of the invention to provide additives which can be prepared in a simple and inexpensive manner. At the same time, they should be producible on the industrial scale without novel plants or plants of complicated construction being required for this purpose.

SUMMARY OF THE INVENTION

The present invention relates to a lubricant composition comprising:

(A) 1% by weight to 15% by weight, preferably 2% to 8% by weight, of one or more polyalkyl(meth)acrylate(s) comprising monomer units of:

(a) 0 to 40% by weight of one or more ethylenically unsaturated ester compounds of the formula (I)

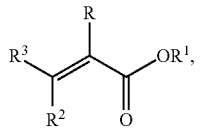

(I)

wherein

R is hydrogen or methyl, $R^1$ is a saturated or unsaturated linear or branched alkyl radical having 1 to 5 carbon atoms or a saturated or unsaturated cycloalkyl group having 3 to 5 carbon atoms, $R^2$ and $R^3$ are each independently hydrogen or a group of the formula —COOR' wherein R' is hydrogen or a saturated or unsaturated linear or branched alkyl group having 1 to 5 carbon atoms;

(b) 10 to 98% by weight, preferably 20 to 95% by weight, of one or more ethylenically unsaturated ester compounds of the formula (II)

(II)

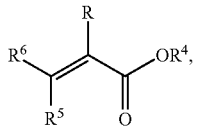

wherein

R is hydrogen or methyl, $R^4$ is a saturated or unsaturated linear or branched alkyl radical having 6 to 15 carbon atoms or a saturated or unsaturated cycloalkyl group having 6 to 15 carbon atoms, $R^5$ and $R^6$ are each independently hydrogen or a group of the formula —COOR" in which R" is hydrogen or a saturated or unsaturated linear or branched alkyl group having 6 to 15 carbon atoms;

(c) 0 to 30% by weight, preferably 5 to 20% by weight, of one or more ethylenically unsaturated ester compounds of the formula (III)

(III)

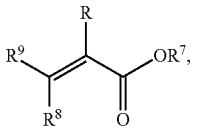

wherein

R is hydrogen or methyl, $R^7$ is a saturated or unsaturated linear or branched alkyl radical having 16 to 40, preferably 16 to 30, carbon atoms or a cycloalkyl group having 16 to 40, preferably 16 to 30, carbon atoms, $R^8$ and $R^9$ are each independently hydrogen or a group of the formula —COOR'" in which R'" is hydrogen or a saturated or unsaturated linear or branched alkyl group having 16 to 40, preferably 16 to 30, carbon atoms;

(d) 0 to 30% by weight of vinyl monomers;

(e) 2 to 10% by weight of at least one N-dispersant monomer, wherein components (a) to (e) add up to 100% by weight;

(B) one or more organomolybdenum compound(s) at an amount which provides 1 ppm to 1000 ppm, preferably 500 to 1000 ppm, of Mo;

(C) a phosphorus compound at an amount which provides 25 ppm to 650 ppm, preferably 150 to 500 ppm, of P;

(D) an antioxidant system, comprising (i) an aminic antioxidant, at about 0.1% by weight to 2.0% by weight, preferably about 0.25% by weight to 1.25% by weight, more preferably about 0.5% by weight to 1.5% by weight;

(ii) a phenolic antioxidant, at about 0.1% by weight to 2.0% by weight, preferably about 0.5% by weight to 1.5% by weight, more preferably about 0.75% by weight to 1.5% by weight;

(iii) an ashless dithiocarbamate, at about 0.1% by weight to 2.0%, preferably about 0.25% by weight to 1.5% by weight, more preferably about 0.4% by weight to 1.0% by weight, and most preferably about 0.4% by weight to 0.9% by weight; and (E) a base oil;

wherein the sum of all components of the composition (A) to (d) add up to 100% by weight.

The lubricant composition imparts improved fuel economy, reduced copper corrosion and lower turbocharger deposits to a finished oil.

It is therefore a further object of the present invention to provide a method of lubricating an engine to provide low, regular and/or high temperature fuel economy, comprising lubricating an engine with the lubricating composition according to the present invention.

It is a further object of the present invention to provide a method for improving fuel economy, comprising adding the above mentioned lubricant composition to an oil.

It is a further object of the present invention to provide a method for reducing copper corrosion and lower turbocharger deposits by adding the above mentioned lubricant composition to an oil.

DETAILED DESCRIPTION OF THE PRESENT INVENTION

Within the context of the present invention, the term "(meth)acrylate" encompasses methacrylates and acrylates, and mixtures of the two. These monomers are widely known.

Monomer unit (a) is present in an amount of 0 to 40% by weight, preferably 1 to 20% by weight, more preferably 5 to 20% by weight, based on the total weight of components (a), (b), (c), (d) and (e).

Non-limiting examples of monomer unit(s) (a) of formula (I) include (meth)acrylates, fumarates and maleates, preferably (meth)acrylates, which derive from saturated alcohols such as methyl(meth)acrylate, ethyl(meth)acrylate, n-propyl (meth)acrylate, iso-propyl(meth)acrylate, n-butyl(meth) acrylate, tert-butyl(meth)acrylate and pentyl(meth)acrylate, methyl(meth)acrylate and/or n butyl(meth)acrylate being preferred; cycloalkyl(meth)acrylates such as cyclopentyl (meth)acrylate; (meth)acrylates which derive from unsaturated alcohols, such as 2-propynyl(meth)acrylate, allyl (meth)acrylate and vinyl(meth)acrylate or dimethylfumarate.

Monomer unit (b) is present in an amount of 10 to 98% by weight, preferably 20 to 95% by weight, based on the total weight of components (a), (b), (c), (d) and (e).

Non-limiting examples of monomer unit(s) of formula (II) include (meth)acrylates, fumarates and maleates, preferably (meth)acrylates, which derive from saturated alcohols, such as hexyl(meth)acrylate, 2-ethylhexyl(meth)acrylate, heptyl (meth)acrylate, 2-tert-butylheptyl(meth)acrylate, octyl (meth)acrylate, 3-isopropylheptyl(meth)acrylate, nonyl (meth)acrylate, decyl(meth)acrylate, undecyl(meth)acrylate, 5-methylundecyl(meth)acrylate, dodecyl(meth)acrylate, 2-methyldodecyl(meth)acrylate, tridecyl(meth)acrylate, 5-methyltridecyl(meth)acrylate, tetradecyl(meth)acrylate, pentadecyl(meth)acrylate; (meth)acrylates which derive from unsaturated alcohols, such as oleyl(meth)acrylate; cycloalkyl(meth)acrylates, such as 3-vinylcyclohexyl(meth) acrylate, cyclohexyl(meth)acrylate, bornyl(meth)acrylate; and the corresponding fumarates and maleates.

In a preferred embodiment, monomer (b) is a $C_{8-15}$-alkyl (meth)acrylate, preferably commercial lauryl(meth)acrylate, or a $C_{10-15}$-alkyl(meth)acrylate fraction. More preferably the backbone monomer is a $C_{8-15}$-alkyl methacrylate, preferably commercial laurylmethacrylate or a $C_{10-15}$-alkyl methacrylate fraction.

Monomer unit (c) is present in an amount of 0 to 30% by weight, preferably 5 to 20% by weight, based on the total weight of components (a), (b), (c), (d) and (e).

Non-limiting examples of monomer unit(s) of formula (III) include (meth)acrylates which derive from saturated alcohols, such as hexadecyl(meth)acrylate, 2-methylhexadecyl(meth)acrylate, heptadecyl(meth)acrylate, 5-isopropylheptadecyl(meth)acrylate, 4-tert-butyloctadecyl(meth)acrylate, 5-ethyloctadecyl(meth)acrylate, 3-isopropyloctadecyl (meth)acrylate, octadecyl(meth)acrylate, nonadecyl(meth) acrylate, eicosyl(meth)acrylate, cetyleicosyl(meth)acrylate, stearyleicosyl(meth)acrylate, docosyl(meth)acrylate and/or eicosyltetratriacontyl(meth)acrylate; cycloalkyl(meth)acrylates such as 2,4,5-tri-tert-butyl-3-vinylcyclohexyl(meth) acrylate, 2,3,4,5-tetra-tert-butylcyclohexyl(meth)acrylate; oxiranyl methacrylates such as 10,11-epoxyhexadecyl methacrylate; and the corresponding fumarates and maleates.

Monomer (d), when present may be a vinyl aromatic monomer such as styrene and substituted styrenes although other vinyl monomers can also be used. The substituted styrenes include styrenes that have halo-, amino-, alkoxy-, carboxy-, hydroxy-, sulfonyl- or hydrocarbyl-substituents, wherein the hydrocarbyl group has from 1 to 12 carbon atoms and other substituents. Exemplary of the hydrocarbyl-substituted styrenes are alpha-methylstyrene, para-tert-butylstyrene, alpha-ethylstyrene, and para-lower alkoxy styrene. Mixtures of two or more vinyl monomers can be used. According to the present invention styrene is preferred.

The amount of vinyl monomer used is from 0 to 30% by weight based on the total weight of components (a), (b), (c), (d) and (e).

Monomer (e) is at least one monomer selected from the group consisting of N-vinylic monomers, (meth)acrylic esters, (meth)acrylic amides, (meth)acrylic imides each with dispersing moieties in the side chain and may be an N-dispersant monomer of the formula (IV)

(IV)

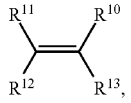

wherein $R^{10}$, $R^{11}$ and $R^{12}$ independently are H or a linear or branched alkyl group with 1 to 5 carbon atoms and $R^{13}$ is either a group C(Y)X—$R^{14}$ with X═O or X═NH and Y is (═O) or (═$NR^{15}$), where $R^{15}$ is an alkyl group with 1 to 8 carbon atoms or an aryl group, and $R^{14}$ represents a linear or branched alkyl group with 1 to 20 carbon atoms which is substituted by a group —$NR^{16}R^{17}$ wherein $R^{16}$ and $R^{17}$ independently represent H or a linear or branched alkyl group with 1 to 8 carbon atoms, or wherein $R^{16}$ and $R^{17}$ together with the nitrogen to which they are bound form a 4- to 8-membered saturated or unsaturated ring containing optionally one or more hetero atoms chosen from the group consisting of nitrogen, oxygen or sulfur, wherein said ring may be further substituted with alkyl or aryl groups, or $R^{13}$ is a group $NR^{18}R^{19}$, wherein $R^{18}$ and $R^{19}$ together with the nitrogen to which they are bound form a 4- to 8-membered saturated or unsaturated ring, containing at least one carbon atom as part of the ring which forms a double bond to a hetero atom chosen from the group consisting of nitrogen, oxygen or sulfur, wherein said ring may be further substituted with alkyl or aryl groups.

In one embodiment, $R^{14}$ represents H or a linear or branched alkyl group with 2 to 6 carbon atoms.

Non-limiting examples of N-dispersant monomers include those selected from the group consisting of vinyl substituted nitrogen heterocyclic monomers, for example vinyl pyridine, and N-vinyl-substituted nitrogen heterocyclic monomers, for example, N-vinyl imidazole, N-vinyl pyrrolidinone (NVP), morpholinoethyl methacrylate and N-vinyl caprolactam; dialkylaminoalkyl acrylate and methacrylate monomers, for example N,N-dialkylaminoalkyl acrylates, for example N,N-dimethylaminoethyl methacrylate (DMAEMA), tert-butyl aminoethyl methacrylate, dialkylaminoalkyl acrylamide and methacrylamide monomers, for example di-lower alkylaminoalkylacrylamide, especially where each alkyl or aminoalkyl group contains from 1 to about 8 carbon atoms, especially from 1 to 3 carbon atoms, for example N,N-dialkyl, especially, N,N-dimethylaminopropylmethacrylamide (DMAPMAM), dimethylaminopropylacrylamide, dimethylaminoethylacrylamide, N-tertiary alkyl acrylamides and corresponding methacrylamides, for example tertiary butyl acrylamide, vinyl substituted amines, and N-vinyl lactam such as N-vinyl pyrrolidinone.

The N-dispersant monomer may specifically be at least one monomer selected from the group consisting of N-vinyl pyrrolidinone, N,N-dimethylaminoethyl methacrylate, and N,N-dimethylaminopropyl methacrylamide.

By virtue to the presence of basic nitrogen groups in the polymer, it is readily apparent that some or all of the nitrogen atoms may be converted to a salt form by reaction with an acid.

Accordingly, the polyalkyl(meth)acrylate) may be partially or completely neutralized by reaction with acidic compounds and still be within the scope of the invention.

In another embodiment, the N-dispersant monomer (e) may comprise a combination of (i) an acrylamide based N-dispersant monomer of the formula (IV)

(IV)

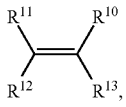

wherein $R^{10}$, $R^{11}$ and $R^{12}$ independently are H or an alkyl group with 1 to 5 carbon atoms and $R^{13}$ is either a group C(Y)X—$R^{14}$ with X═O or X═NH and Y is (═O) or (═$NR^{15}$), where $R^{15}$ is an alkyl group with 1 to 8 carbon atoms or an aryl group, and $R^{14}$ represents a linear or branched alkyl group with 1 to 20 carbon atoms which is substituted by a group —$NR^{16}R^{17}$ where $R^{16}$ and $R^{17}$ independently represent H or a linear or branched alkyl group with 1 to 8 carbon atoms, or wherein $R^{16}$ and $R^{17}$ are part of a 4- to 8-membered saturated or unsaturated ring containing optionally one or more hetero atoms chosen from the group consisting of nitrogen, oxygen or sulfur, wherein said ring may be further substituted with alkyl or aryl groups, and (ii) an N-dispersant monomer of the formula (IV)

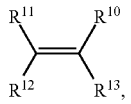

wherein $R^{10}$, $R^{11}$ and $R^{12}$ independently are H or an alkyl group with 1 to 5 carbon atoms and $R^{13}$ is a group —$NR^{18}R^{19}$, wherein $R^{18}$ and $R^{19}$ are part of a 4- to 8-membered saturated or unsaturated ring, containing at least one carbon atom as part of the ring which forms a double bond to a hetero atom chosen from the group consisting of nitrogen, oxygen or sulfur, wherein said ring may be further substituted with alkyl or aryl groups, in amounts of 0% to 10% by weight, preferably up to 4% by weight, based on the total weight of the polyalkyl(meth)acrylate, the total amount of N-dispersant monomer not exceeding 25% by weight based on the total weight of the polyalkyl(meth) acrylate.

Preferably, the monomer wherein $R^{13}$ is a group —$NR^{18}R^{19}$ is N-vinyl pyrrolidinone.

The amount of N-dispersant monomer is typically from 2 to 10% by weight based on the total weight of components (a), (b), (c), (d) and (e).

It may be beneficial to use at least two N-dispersant monomers, especially when the total amount of N-dispersant monomer is at the low end of the recited range.

In another embodiment, the polyalkyl(meth)acrylate (A) may be comprised of:

(a) 10 to 98% by weight, preferably 20 to 95% by weight, of one or more ethylenically unsaturated ester compounds of the formula (II)

(II)

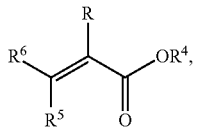

wherein

R is hydrogen or methyl, $R^4$ is a saturated or unsaturated linear or branched alkyl radical having 6 to 15 carbon atoms or a saturated or unsaturated cycloalkyl group having 6 to 15 carbon atoms, $R^5$ and $R^6$ are each independently hydrogen or a group of the formula —COOR" in which R" is hydrogen or a saturated or unsaturated linear or branched alkyl group having 6 to 15 carbon atoms;

(b) 0 to 30% by weight, preferably 5 to 20% by weight, of one or more ethylenically unsaturated ester compounds of the formula (III)

(III)

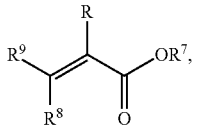

wherein

R is hydrogen or methyl, $R^7$ is a saturated or unsaturated linear or branched alkyl radical having 16 to 40, preferably 16 to 30, carbon atoms or a cycloalkyl group having 16 to 40, preferably 16 to 30, carbon atoms, $R^8$ and $R^9$ are each independently hydrogen or a group of the formula —COOR'" in which R'" is hydrogen or a saturated or unsaturated linear or branched alkyl group having 16 to 40, preferably 16 to 30, carbon atoms;

(c) 2 to 10% by weight of at least one N-dispersant monomer, wherein components (a), (b) and (c) add up to 100% by weight.

The polyalkyl(meth)acrylate (A) typically has a number average molecular weight $M_n$ of from 5000 to 1000000 g/mol, preferably from 25000 to 1000000 g/mol, as measured by size exclusion chromatography, calibrated versus a polystyrene standard.

Of particular interest, among others, are polyalkyl(meth) acrylates (A) which preferably have a weight-average molecular weight $M_w$ in the range from 7500 to 1000000 g/mol, more preferably 10000 to 600000 g/mol and most preferably 25000 to 400000 g/mol.

Additionally appropriate are polyalkyl(meth)acrylate (A) whose polydispersity index $M_w/M_n$ is in the range from 1 to 5, more preferably in the range from 1.05 to 4. The number-average and weight-average molecular weights can be determined by known processes, for example gel permeation chromatography (GPC).

In a preferred embodiment of the present invention the polyalkyl(meth)acrylates (A) have a weight-average molecular weight $M_w$ in the range from 5000 to 1000000 g/mol, preferably from 25000 to 1000000 g/mol, more preferably from 300000 to 800000 g/mol, as measured by size exclusion chromatography, calibrated versus a polystyrene standard, and a number average molecular weight $M_n$ of from 7500 to 1000000 g/mol, more preferably 10000 to 600000 g/mol and most preferably 25000 to 400000 g/mol and most preferably 25000 to 200000 g/mol.

Alternatively, the polyalkyl(meth)acrylate (A) typically will have a shear stability from 2 to 55% as measured by the 20 hour KRL shear stability test (CEC 45-T-53).

The polyalkyl(meth)acrylates (A) may have a variety of structures. For example, the polymer may be present as a diblock, triblock, multiblock, comb and/or star copolymer which has corresponding polar and nonpolar segments. In addition, the polymer may especially be present as a graft copolymer.

The polyalkyl(meth)acrylates (A) for use in accordance with the invention can be obtained in various ways. A preferred process consists in free-radical graft copolymerization which is known per se, wherein, for example, a graft base is obtained in a first step, onto which dispersing monomers are grafted in a second step.

The monomers with a long-chain alcohol radical, especially components (b) and (c), can be obtained, for example, by reacting (meth)acrylates, fumarates, maleates and/or the corresponding acids with long-chain fatty alcohols, which generally gives a mixture of esters, for example (meth) acrylates with different long-chain alcohol radicals. These fatty alcohols include Oxo Alcohol® 7911, Oxo Alcohol® 7900, Oxo Alcohol® 1100; Alfol® 610, Alfol® 810, Lial® 125 and Nafol® types (Sasol); Alphanol® 79 (101); Epal® 610 and Epal® 810 (Afton); Linevol® 79, Linevol® 911 and Neodol® 25E (Shell); Dehydad®, Hydrenol® and Lorol® types (Cognis); Acropol® 35 and Exxal® 10 (Exxon Chemicals); Kalcol® 2465 (Kao Chemicals).

Among the ethylenically unsaturated ester compounds, the (meth)acrylates are particularly preferred over the maleates and fumarates, i.e. $R^2$, $R^3$, $R^5$, $R^6$, $R^8$ and $R^9$ of the formulae (I), (II) and (III) are each hydrogen in particularly preferred embodiments.

The weight ratio of ester monomers of the formula (II) to the ester monomers of the formula (III) may be within a wide range. The ratio of ester compounds of the formula (II) which have 6 to 15 carbon atoms in the alcohol radical to the ester compounds of the formula (III) which have 16 to 40 carbon atoms in the alcohol radical is preferably in the range from 50:1 to 1:30, more preferably in the range from 10:1 to 1:3, especially preferably 5:1 to 1:1.

The aforementioned ethylenically unsaturated monomers may be used individually or as mixtures.

Additionally, the polyalkyl(meth)acrylates according to the present invention may comprise one or more further comonomers.

Particularly suitable comonomers for polymerization according to the present invention are those which correspond to the formula (V)

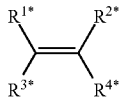

(V)

wherein $R^{1*}$ and $R^{2*}$ are each independently selected from the group consisting of hydrogen, halogens, CN, linear or branched alkyl groups having 1 to 20, preferably 1 to 6 and more preferably 1 to 4, carbon atoms, which may be substituted by 1 to (2n+1) halogen atoms, where n is the number of carbon atoms of the alkyl group (for example $CF_3$), α,β-unsaturated linear or branched alkenyl or alkynyl groups having 2 to 10, preferably 2 to 6 and more preferably 2 to 4, carbon atoms, which may be substituted by 1 to (2n−1) halogen atoms, preferably chlorine, where n is the number of carbon atoms of the alkyl group, for example $CH_2{=}CCl{-}$, cycloalkyl groups having 3 to 8 carbon atoms, which may be substituted by 1 to (2n−1) halogen atoms, preferably chlorine, where n is the number of carbon atoms of the cycloalkyl group; $C({=}Y^*)R^{5*}$, $C({=}Y^*)NR^{6*}R^{7*}$, $Y^*C({=}Y^*)R^{6*}$, $SOR^{5*}$, $SO_2R^{5*}$, $OSO_2R^{5*}$, $NR^{8*}SO_2R^{5*}$, $PR^{5*}_2$, $P({=}Y^*)R^{5*}_2$, $Y^*PR^{5*}_2$, $Y^*P({=}Y^*)R^{5*}_2$, $NR^{8*}_2$ which may be quaternized with an additional $R^{8*}$, aryl or heterocyclyl group, where Y* may be $NR^{8*}$, S or O, preferably O; $R^{5*}$ is an alkyl group having 1 to 20 carbon atoms, an alkylthio having 1 to 20 carbon atoms, $OR^{15}$ ($R^{15}$ is hydrogen or an alkali metal), alkoxy of 1 to 20 carbon atoms, aryloxy or heterocyclyloxy; $R^{6*}$ and $R^{7*}$ are each independently hydrogen or an alkyl group having 1 to 20 carbon atoms, or $R^{6*}$ and $R^{7*}$ together may form an alkylene group having 2 to 7 and preferably 2 to 5 carbon atoms, in which case they form a 3- to 8-membered ring, preferably a 3- to 6-membered ring, and $R^{8*}$ is hydrogen, linear or branched alkyl or aryl groups having 1 to 20 carbon atoms;

$R^{3*}$ and $R^{4*}$ are independently selected from the group consisting of hydrogen, halogen, preferably fluorine or chlorine, alkyl groups having 1 to 6 carbon atoms and $COOR^{9*}$ in which $R^{9*}$ is hydrogen, an alkali metal or an alkyl group having 1 to 40 carbon atoms, or $R^{1*}$ and $R^{3*}$ together may form a group of the formula $(CH_2)_n$, which may be substituted by 1 to 2n' halogen atoms or $C_{1-4}$-alkyl groups, or form the formula $C({=}O){-}Y^*{-}C({=}O)$ where n' is 2 to 6, preferably 3 or 4, and Y* is as defined above; and where at least 2 of the $R^{1*}$, $R^{2*}$, $R^{3*}$ and $R^{4*}$ radicals are hydrogen or halogen.

The preferred comonomers include vinyl halides, for example vinyl chloride, vinyl fluoride, vinylidene chloride and vinylidene fluoride;

styrene, substituted styrenes having an alkyl substituent in the side chain, for example alpha-methylstyrene and alpha-ethylstyrene, substituted styrenes having an alkyl substituent on the ring, such as vinyltoluene and p-methylstyrene, halogenated styrenes, for example monochlorostyrenes, dichlorostyrenes, tribromostyrenes and tetrabromostyrenes; vinyl and isoprenyl ethers;

maleic acid and maleic acid derivatives different from those mentioned under (I), (II) and (III), for example maleic anhydride, methylmaleic anhydride, maleimide, methylmaleimide; fumaric acid and fumaric acid derivatives different from those mentioned under (I), (II) and (III).

The proportion of comonomers is preferably 0% to 50% by weight, more preferably 0.1% to 40% by weight and most preferably 0.5% to 20% by weight, based on the weight of the monomer composition.

The polymers for use in accordance with the invention exhibit a particularly favourable profile of properties. For instance, the polymers can be configured so as to be surprisingly shear-stable, such that the lubricants have a very long service life. In addition, the additive for use in accordance with the invention may bring about a multitude of desirable properties in the lubricant. For example, it is possible to produce lubricants with outstanding low-temperature properties or viscosity properties, which comprise the present polymers comprising ester groups. This allows the number of different additives to be minimized. Furthermore, the present polyalkyl(meth)acrylates are compatible with many additives. This allows the lubricants to be adjusted to a wide variety of different requirements.

Molybdenum additives (B) are well known to those skilled in the art of oil formulation to act as friction modifiers to reduce engine friction and thereby improve vehicle fuel economy. However, it is also well known that high levels of molybdenum in engine oil can cause engine corrosion, deposits and wear. When this occurs, engine life expectancy is greatly reduced.

A preferred organomolybdenum compound is prepared by reacting about 1 mole of fatty oil, about 1.0 to 2.5 moles of diethanolamine and a molybdenum source sufficient to yield about 0.1 to 12.0 percent of molybdenum based on the weight of the complex at elevated temperatures (i.e. greater than room temperature). A temperature range of about 70° C. to 160° C. is considered to be an example of an embodiment of the invention. The organomolybdenum component of the invention is prepared by sequentially reacting fatty oil, diethanolamine and a molybdenum source by the condensation method described in U.S. Pat. No. 4,889,647, incorporated herein by reference, and is commercially available from R.T. Vanderbilt Company, Inc. of Norwalk, Conn. as Molyvan® 855.

Molyvan® 855 can also be expressed as the product which arises from reacting coconut oil with diethanol amine, followed by reaction with molybdenum trioxide in the presence of 1-hydroxyethyl-2-alkyl or alkenyl (C15-19, predominantly C17)-imidazole as catalyst, mainly consisting of [2,2'-(alkyl(C7-17, predominantly C11)imino)diethanolato]dioxomolybdenum (VI) and [3-(alkyl(C7-17, predominantly C11)oxy)-1,2-propanediolato] dioxomolybdenum (VI).

The reaction yields a reaction product mixture.

The major components, among others present, are believed to have the following structural formulae (VIa) or (VIb)

(VIa)

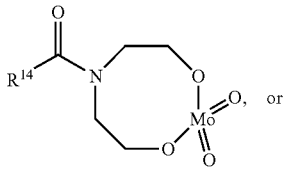

(VIb)

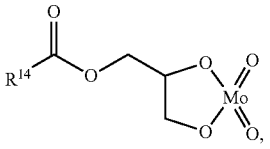

wherein $R^{14}$ represents a fatty oil residue. An embodiment for the present invention are fatty oils which are glyceryl esters of higher fatty acids containing at least 12 carbon atoms and may contain 22 carbon atoms and higher. Such esters are commonly known as vegetable and animal oils. Examples of useful vegetable oils are oils derived from coconut, corn, cottonseed, linseed, peanut, soybean and sunflower seed. Similarly, animal fatty oils such as tallow may be used. The source of molybdenum may be an oxygen-containing molybdenum compound capable of reacting with the intermediate reaction product of fatty oil and diethanolamine to form an ester-type molybdenum complex. The source of molybdenum includes, among others, ammonium molybdates, molybdenum oxides and mixtures thereof.

A sulfur- and phosphorus-free organomolybdenum compound that may be used may be prepared by reacting a sulfur- and phosphorus-free molybdenum source with an organic compound containing amino and/or alcohol groups. Examples of sulfur- and phosphorus-free molybdenum sources include molybdenum trioxide, ammonium molybdate, sodium molybdate and potassium molybdate. The amino groups may be monoamines, diamines, or polyamines. The alcohol groups may be mono-substituted alcohols, diols or bis-alcohols, or polyalcohols. As an example, the reaction of diamines with fatty oils produces a product containing both amino and alcohol groups that can react with the sulfur- and phosphorus-free molybdenum source.

Examples of sulfur- and phosphorus-free organomolybdenum compounds include the following:

1. Compounds prepared by reacting certain basic nitrogen compounds with a molybdenum source as described in U.S. Pat. Nos. 4,259,195 and 4,261,843.

2. Compounds prepared by reacting a hydrocarbyl substituted hydroxy alkylated amine with a molybdenum source as described in U.S. Pat. No. 4,164,473.

3. Compounds prepared by reacting a phenol aldehyde condensation product, a mono-alkylated alkylene diamine, and a molybdenum source as described in U.S. Pat. No. 4,266,945.

4. Compounds prepared by reacting a fatty oil, diethanolamine, and a molybdenum source as described in U.S. Pat. No. 4,889,647.

5. Compounds prepared by reacting a fatty oil or acid with 2-(2-aminoethyl)aminoethanol, and a molybdenum source as described in U.S. Pat. No. 5,137,647.

6. Compounds prepared by reacting a secondary amine with a molybdenum source as described in U.S. Pat. No. 4,692,256.

7. Compounds prepared by reacting a diol, diamino, or amino-alcohol compound with a molybdenum source as described in U.S. Pat. No. 5,412,130.

8. Compounds prepared by reacting a fatty oil, monoalkylated alkylene diamine, and a molybdenum source as described in U.S. Pat. No. 6,509,303.

9. Compounds prepared by reacting a fatty acid, monoalkylated alkylene diamine, glycerides, and a molybdenum source as described in U.S. Pat. No. 6,528,463.

Examples of commercially available sulfur- and phosphorus-free oil soluble molybdenum compounds are available under the trade name SAKURA-LUBE from Adeka Corporation (formerly Asahi Denka Kogyo K.K.), and MOLYVAN®. from R.T. Vanderbilt Company, Inc.

Sulfur-containing organomolybdenum compounds may be used and may be prepared by a variety of methods. One method involves reacting a sulfur and phosphorus-free molybdenum source with an amino group and one or more sulfur sources. Sulfur sources can include for example, but are not limited to, carbon disulfide, hydrogen sulfide, sodium sulfide and elemental sulfur. Alternatively, the sulfur-containing molybdenum compound may be prepared by reacting a sulfur-containing molybdenum source with an amino group or thiuram group and optionally a second sulfur source. Examples of sulfur- and phosphorus-free molybdenum sources include molybdenum trioxide, ammonium molybdate, sodium molybdate, potassium molybdate, and molybdenum halides. The amino groups may be monoamines, diamines, or polyamines. As an example, the reaction of molybdenum trioxide with a secondary amine and carbon disulfide produces molybdenum dithiocarbamates. Alternatively, the reaction of $(NH_4)_2Mo_3S_{13}.H_2O$ where n varies between 0 and 2, with a tetralkylthiuram disulfide, produces a trinuclear sulfur-containing molybdenum dithiocarbamate.

Examples of sulfur-containing organomolybdenum compounds appearing in patents and patent applications include the following:

1. Compounds prepared by reacting molybdenum trioxide with a secondary amine and carbon disulfide as described in U.S. Pat. Nos. 3,509,051 and 3,356,702.

2. Compounds prepared by reacting a sulfur-free molybdenum source with a secondary amine, carbon disulfide, and an additional sulfur source as described in U.S. Pat. No. 4,098,705.

3. Compounds prepared by reacting a molybdenum halide with a secondary amine and carbon disulfide as described in U.S. Pat. No. 4,178,258.

4. Compounds prepared by reacting a molybdenum source with a basic nitrogen compound and a sulfur source as described in U.S. Pat. Nos. 4,263,152, 4,265,773, 4,272,387, 4,285,822, 4,369,119, and 4,395,343.

5. Compounds prepared by reacting ammonium tetrathiomolybdate with a basic nitrogen compound as described in U.S. Pat. No. 4,283,295.

6. Compounds prepared by reacting an olefin, sulfur, an amine and a molybdenum source as described in U.S. Pat. No. 4,362,633.

7. Compounds prepared by reacting ammonium tetrathiomolybdate with a basic nitrogen compound and an organic sulfur source as described in U.S. Pat. No. 4,402,840.

8. Compounds prepared by reacting a phenolic compound, an amine and a molybdenum source with a sulfur source as described in U.S. Pat. No. 4,466,901.

9. Compounds prepared by reacting a triglyceride, a basic nitrogen compound, a molybdenum source, and a sulfur source as described in U.S. Pat. No. 4,765,918.

10. Compounds prepared by reacting alkali metal alkylthioxanthate salts with molybdenum halides as described in U.S. Pat. No. 4,966,719.

11. Compounds prepared by reacting a tetralkylthiuram disulfide with molybdenum hexacarbonyl as described in U.S. Pat. No. 4,978,464.

12. Compounds prepared by reacting an alkyl dixanthogen with molybdenum hexacarbonyl as described in U.S. Pat. No. 4,990,271.

13. Compounds prepared by reacting alkali metal alkylxanthate salts with dimolybdenum tetra-acetate as described in U.S. Pat. No. 4,995,996.

14. Compounds prepared by reacting $(NH_4)_2Mo_3S_{13}.H_2O$ with an alkali metal dialkyldithiocarbamate or tetralkyl thiuram disulfide as described in U.S. Pat. No. 6,232,276.

15. Compounds prepared by reacting an ester or acid with a diamine, a molybdenum source and carbon disulfide as described in U.S. Pat. No. 6,103,674.

16. Compounds prepared by reacting an alkali metal dialkyldithiocarbamate with 3-chloropropionic acid, followed by molybdenum trioxide, as described in U.S. Pat. No. 6,117,826.

17. Trinuclear moly compounds prepared by reacting a moly source with a ligand sufficient to render the moly additive oil soluble and a sulfur source as described in patents: U.S. Pat. Nos. 6,232,276; 7,309,680 and WO99/31113, e.g. Infineum® C9455B.

18. Molybdenum dithiocarbamate compositions produced from di-isotridecylamine derived from oligomerization of butylene feedstocks composed of major amount (>50%) of 2-butylene and minor amounts of 1-butylene and/or isobutylene, and as a result of which have on average greater than 98% of 013 present as the constituent R groups.

Examples of commercially available sulfur-containing, oil soluble molybdenum compounds available under the trade name SAKURA-LUBE, from Adeka Corporation, MOLYVAN® additives from R. T. Vanderbilt Company, and NAUGALUBE from Crompton Corporation.

Molybdenum dithiocarbamates may be present as either the organomolybdem compound and/or as the dithiocarbamate, and may be illustrated by the following structure (VII)

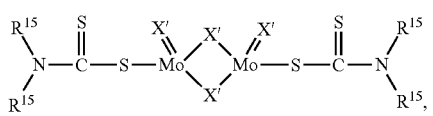

(VII)

wherein $R^{15}$ independently denotes an alkyl group, which may be the same or different, containing 4 to 18 carbon atoms or H, and X' denotes O or S.

Other oil-solube organomolybdenum compounds which may be used in the present invention include molybdenum dithiocarbamates, amine molybdates, molybdate esters, molybdate amides and alkyl molybdates.

It is contemplated that oil-soluble organotungsten compounds may be substituted for the organomolybdenum compound, including amine tungstate (Vanlube® W 324) and tungsten dithiocarbamates.

Preferred Molybdenum-containing compounds according to the present invention are Molybdenum ester amide such as MOLYVAN®-855 and Molybdenum dithiocarbamates such as MOLYVAN®-822 and MOLYVAN®-2000.

Phosphorous containing compounds (C) which can be used according to the present invention are described in U.S. Pat. No. 8,084,403 B2 which is incorporated by reference. Such compounds include zinc dialkyldithiophosphate (ZDDP) compositions that include one or more ZDDP compounds. Any ZDDP compound can be used that meets the phosphorous volatility specification of GF-5 and any future passenger car motor oil specification. Suitable ZDDP compounds may be prepared from specific amounts of primary alcohols, secondary alcohols, and mixtures of primary and secondary alcohols. The ZDDP compounds may also be combined to provide ZDDP compositions having primary-to-secondary alkoxy moiety ratios that range from about 100:0 to about 65:35. As an even further example, the ZDDP compounds may be combined so that the mole ratio of primary to secondary alkoxy moieties ranges from 95:5 to 70:30.

In addition to selecting ZDDP's made from primary and/or secondary alcohols, certain alkoxy moiety chain lengths are more suitable than others for ZDDP compositions that are effective for reducing engine deposits. For example, a ZDDP composition may contain alkoxy moieties derived from alcohols having from 3 to 12 carbon atoms. The alcohols used may be primary or secondary alcohols and my be linear or branched.

TERMS AND DEFINITIONS

According to the invention, aromatic or aryl groups denote radicals of mono- or polycyclic aromatic compounds having preferably 6 to 20 and especially 6 to 12 carbon atoms. Heteroaromatic or heteroaryl groups denote aryl radicals in which at least one CH group has been replaced by N and/or at least two adjacent CH groups have been replaced by S, NH or O, heteroaromatic groups having 3 to 19 carbon atoms.

Aromatic or heteroaromatic groups preferred in accordance with the invention derive from benzene, naphthalene, biphenyl, diphenyl ether, diphenylmethane, diphenyldimethylmethane, bisphenone, diphenyl sulfone, thiophene, furan, pyrrole, thiazole, oxazole, imidazole, isothiazole, isoxazole, pyrazole, 1,3,4-oxadiazole, 2,5-diphenyl-1,3,4-oxadiazole, 1,3,4-thiadiazole, 1,3,4-triazole, 2,5-diphenyl-1,3,4-triazole, 1,2,5-triphenyl-1,3,4-triazole, 1,2,4-oxadiazole, 1,2,4-thiadiazole, 1,2,4-triazole, 1,2,3-triazole, 1,2,3,4-tetrazole, benzo[b]thiophene, benzo[b]furan, indole, benzo[c]thiophene, benzo[c]furan, isoindole, benzoxazole, benzothiazole, benzimidazole, benzisoxazole, benzisothiazole, benzopyrazole, benzothiadiazole, benzotriazole, dibenzofuran, dibenzothiophene, carbazole, pyridine, bipyridine, pyrazine, pyrazole, pyrimidine, pyridazine, 1,3,5-triazine, 1,2,4-triazine, 1,2,4,5-triazine, tetrazine, quinoline, isoquinoline, quinoxaline, quinazoline, cinnoline, 1,8-naphthyridine, 1,5-naphthyridine, 1,6-naphthyridine, 1,7-naphthyridine, phthalazine, pyridopyrimidine, purine, pteridine or quinolizine, 4H-quinolizine, diphenyl ether, anthracene, benzopyrrole, benzoxathiadiazole, benzoxadiazole, benzopyridine, benzopyrazine, benzopyrazidine, benzopyrimidine, benzotriazine, indolizine, pyridopyridine, imidazopyrimidine, pyrazinopyrimidine, carbazole, aciridine, phenazine, benzoquinoline, phenoxazine, phenothiazine, acridizine, benzopteridine, phenanthroline and phenanthrene, each of which may also optionally be substituted.

The preferred alkyl groups include the methyl, ethyl, propyl, isopropyl, 1-butyl, 2-butyl, 2-methylpropyl, tert-butyl, pentyl, 2-methylbutyl, 1,1-dimethylpropyl, hexyl, heptyl, octyl, 1,1,3,3-tetramethylbutyl, nonyl, 1-decyl, 2-decyl, undecyl, dodecyl, pentadecyl and the eicosyl group.

The preferred cycloalkyl groups include the cyclopropyl, cyclobutyl, cyclopentyl, cyclohexyl, cycloheptyl and the cyclooctyl group, each of which is optionally substituted with linear or branched alkyl groups having 1 to 5 carbon atoms.

The preferred alkanoyl groups include the formyl, acetyl, propionyl, 2-methylpropionyl, butyryl, valeroyl, pivaloyl, hexanoyl, decanoyl and the dodecanoyl group.

The preferred alkoxycarbonyl groups include the methoxycarbonyl, ethoxycarbonyl, propoxycarbonyl, butoxycarbonyl, tert-butoxycarbonyl, hexyloxycarbonyl, 2-methylhexyloxycarbonyl, decyloxycarbonyl or dodecyloxycarbonyl group.

The preferred alkoxy groups include alkoxy groups whose hydrocarbon radical is one of the aforementioned preferred alkyl groups.

The preferred cycloalkoxy groups include cycloalkoxy groups whose hydrocarbon radical is one of the aforementioned preferred cycloalkyl groups.

In addition to the components mentioned above, a lubricant oil composition may comprise further additives. Preferred additives may especially be based on a linear polyalkyl(meth)acrylate having 1 to 30 carbon atoms in the alcohol group (PAMA). These additives include dispersant inhibitor (DI) additives as dispersants, detergents, defoamers, corrosion inhibitors, antioxidants, antiwear additives, extreme pressure additives, friction modifiers, pour point improvers (more preferably based on polyalkyl(meth)acrylate having 1 to 30 carbon atoms in the alcohol group) and/or dyes.

According to another aspect, the present invention relates to a lubricant composition comprising:

(A) 1% by weight to 15% by weight, preferably 2% to 8% by weight, of one or more polyalkyl(meth)acrylate(s) comprising monomer units of:

(a) 0 to 40% by weight of one or more ethylenically unsaturated ester compounds of the formula (I)

(I)

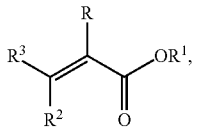

wherein

R is hydrogen or methyl, $R^1$ is a saturated or unsaturated linear or branched alkyl radical having 1 to 5 carbon atoms or a saturated or unsaturated cycloalkyl group having 3 to 5 carbon atoms, $R^2$ and $R^3$ are each independently hydrogen or a group of the formula —COOR' wherein R' is hydrogen or a saturated or unsaturated linear or branched alkyl group having 1 to 5 carbon atoms;

(b) 10 to 98% by weight, preferably 20 to 95% by weight, of one or more ethylenically unsaturated ester compounds of the formula (II)

(II)

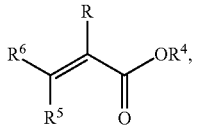

wherein

R is hydrogen or methyl, $R^4$ is a saturated or unsaturated linear or branched alkyl radical having 6 to 15 carbon atoms or a saturated or unsaturated cycloalkyl group having 6 to 15 carbon atoms, $R^5$ and $R^6$ are each independently hydrogen or a group of the formula —COOR" in which R" is hydrogen or a saturated or unsaturated linear or branched alkyl group having 6 to 15 carbon atoms;

(c) 0 to 30% by weight, preferably 5 to 20% by weight, of one or more ethylenically unsaturated ester compounds of the formula (III)

(III)

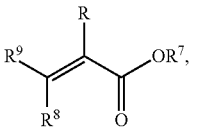

wherein

R is hydrogen or methyl, $R^7$ is a saturated or unsaturated linear or branched alkyl radical having 16 to 40, preferably 16 to 30, carbon atoms or a cycloalkyl group having 16 to 40, preferably 16 to 30, carbon atoms, $R^8$ and $R^9$ are each independently hydrogen or a group of the formula —COOR'" in which R'" is hydrogen or a saturated or unsaturated linear or branched alkyl group having 16 to 40, preferably 16 to 30, carbon atoms;

(d) 0 to 30% by weight of vinyl monomers;

(e) 2 to 10% by weight of at least one N-dispersant monomer, wherein components (a) to (e) add up to 100% by weight;

(B) one or more organomolybdenum compound(s) at an amount which provides 1 ppm to 1000 ppm, preferably 500 to 1000 ppm, of Mo;

(C) a phosphorus compound at an amount which provides 25 ppm to 650 ppm, preferably 150 to 500 ppm, of P;

(D) a base oil;

(E) optionally 1.0% by weight to 10.0% by weight, preferably 2.0 by weight to 6.0% by weight, of a dispersant;

(F) optionally 0.3% by weight to 6.0% by weight, preferably 1.4% by weight to 4.0% by weight, of an antioxidant system, which may comprise one or more of (i) an aminic antioxidant, at about 0.1% by weight to 2.0% by weight, preferably about 0.25% by weight to 1.25% by weight, more preferably about 0.5% by weight to 1.5% by weight;

(ii) a phenolic antioxidant, at about 0.1% by weight to 2.0% by weight, preferably about 0.5% by weight to 1.5% by weight, more preferably about 0.75% by weight to 1.5% by weight; and (iii) an ashless dithiocarbamate, at about 0.1% by weight to 2.0% by weight, preferably about 0.25% by weight to 1.5% by weight, more preferably about 0.4% by weight to 1.0% by weight, and most preferably about 0.4% by weight to 0.9% by weight;

(G) optionally 1.0% by weight to 5.0% by weight, preferably 1.0% by weight to 4.0% by weight, of a metal detergent;

(H) optionally 0% by weight to 3.0% by weight, preferably 0% by weight to 2.0% by weight, of a corrosion inhibitor;

(I) optionally 0.1% by weight to 5.0% by weight, preferably 0.1% by weight to 1.6% by weight, of a pour point depressant;

(J) optionally one or more additional VI improver(s) that totals 0.1% by weight to 8.0% by weight, preferably 2.0% by weight to 6.0% by weight; and (K) optionally an additional polyalkyl(meth)acrylate based VI improver at low molecular weight, wherein the sum of all components of the composition (A) to (K) add up to 100% by weight.

A preferred composition comprises, in combination with a base oil:

The poly(meth)acrylate discussed above as (A), and from among components (B)-(K):

organomolybdenum compounds, including both a molybdate ester such as Molyvan® 855 and a molybdenum dithiocarbamate phosphorous compound being zinc dialkyldithiophosphate, and antioxidant system, including an alkylated diphenylamine such as Vanlube® 961 (mixed octylated and butylated diphenylamines); ashless dithiocarbamate, such as Vanlube® 7723 methylene bis dibutyldithiocarbamate; and phenolic antioxidant, such as Vanlube® BHC iso-octyl-3-(3,5-di-tert-butyl-4-hydroxyphenyl)prioprionate;

A particularly preferred composition further contains, in addition to the above:

metal detergent, such as calcium sulfonate, a dispersant, such as C-9268 bis-succinimide dispersant, a pour point depressant, such as Viscoplex® 1-333 poly (meth)acrylate, and a corrosion inhibitor, such as Vanlube® 887E tolutriazole.

Dispersants contained in a dispersant inhibitor (DI) package may include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described, for example, in U.S. Pat. Nos. 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804 and 5,633,326; Koch dispersants as described in U.S. Pat. Nos. 5,936,041, 5,643,859 and 5,627,259; and polyalkylene succinimide dispersants as described in U.S. Pat. Nos. 5,851,965, 5,853,434 and 5,792,729.

Metal detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, as for example barium, sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450, neutral and overbased calcium phenates and sulfurized phenates having TBN of from 50 to 450 and neutral and overbased magnesium or calcium salicylates having a TBN of from 20 to 450. Combinations of detergents, whether overbased or neutral or both, may be used.

Additives of the polysiloxane type, for example silicone oil or polydimethyl siloxane, can provide foam control.

A small amount of a demulsifying component may be used as defoamer as well. A preferred demulsifying component is described in EP 330 522 A. It may be obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

The inventive lubricant oil compositions may comprise corrosion inhibitors. These are in many cases divided into antirust additives and metal passivators/deactivators. The antirust additives used may, inter alia, be sulphonates, for example petroleumsulphonates or (in many case overbased) synthetic alkylbenzenesulphonates, e.g. dinonylnaphthenesulphonates; carboxylic acid derivatives, for example lanolin (wool fat), oxidized paraffins, zinc naphthenates, alkylated succinic acids, 4-nonylphenoxy-acetic acid, amides and imides (N-acylsarcosine, imidazoline derivatives); amine-neutralized mono- and dialkyl phosphates; morpholine, dicyclohexylamine or diethanolamine. The metal passivators/deactivators include benzotriazole, tolyltriazole, tolutriazole (such as Vanlube® 887 or 887E), 2-mercaptobenzothiazole, dialkyl-2,5-dimercapto-1,3,4-thiadiazole; N,N'-disalicylideneethylenediamine, N,N'-disalicylidenepropylenediamine; zinc dialkyldithiophosphates and dialkyl dithiocarbamates.

The inventive lubricant oil compositions may comprise one or more antioxidant(s). The antioxidants include, for example, phenols, for example 2,6-di-tert-butylphenol (2,6-DTB), butylated hydroxytoluene (BHT), 2,6-di-tert-butyl-4-methylphenol, 4,4'-methylenebis(2,6-di-tert-butylphenol); aromatic amines, especially alkylated diphenylamines, N-phenyl-1-naphthylamine (PNA), polymeric 2,2,4-trimethyldihydroquinone (TMQ); compounds containing sulfur and phosphorus, for example metal dithiophosphates, e.g. zinc dithiophosphates (ZnDTP), "OOS triesters"=reaction products of dithiophosphoric acid with activated double bonds from olefins, cyclopentadiene, norbornadiene, alpha-pinene, polybutene, acrylic esters, maleic esters (ashless on combustion); organosulfur compounds, for example dialkyl sulphides, diaryl sulphides, polysulphides, modified thiols, thiophene derivatives, xanthates, thioglycols, thioaldehydes, sulfur-containing carboxylic acids; heterocyclic sulfur/nitrogen compounds, especially dialkyldimercaptothiadiazoles, 2-mercaptobenzimidazoles; zinc and methylene bis(dialkyldithiocarbamate); organophosphorus compounds, for example triaryl and trialkyl phosphites; organocopper compounds and overbased calcium- and magnesium-based phenolates and salicylates.

Other compounds widely available as antioxidants for lubricants are alkylated diphenyl amines. One possible embodiment of an alkylated diphenyl amine for the invention are secondary alkylated diphenylamines such as those described in U.S. Pat. No. 5,840,672, which is hereby incorporated by reference. These secondary alkylated diphenylamines are described by the formula X—NH—Y, wherein X and Y each independently represent a substituted or unsubstituted phenyl group having wherein the substituents for the phenyl group include alkyl groups having 1 to 20 carbon atoms, preferably 4 to 12 carbon atoms, alkylaryl groups, hydroxyl, carboxy and nitro groups and wherein at least one of the phenyl groups is substituted with an alkyl group of 1 to 20 carbon atoms, preferably 4-12 carbon atoms. It is also possible to use commercially available ADPAs including VANLUBE®SL (mixed alklyated diphenylamines), Vanlube® NA (mixed alklyated diphenylamines), Vanlube® 81 (p,p'-dioctyldiphenylamine) and Vanlube® 961 (mixed octylated and butylated diphenylamines) manufactured by R.T. Vanderbilt Company, Inc., Naugalube® 640, 680 and 438L manufactured by Chemtura Corporation and Irganox® L-57 and L-67 manufactured by Ciba Specialty Chemicals Corporation and Lubrizol 5150A & C manufactured by Lubrizol. Another possible ADPA for use in the invention is a reaction product of N-phenyl-benzenamine and 2,4,4-trimethylpentene.

Further antioxidants are alkylated diphenylamines, also known as diarylamine antioxidants, which include, but are not limited to diarylamines having the formula (VIII)

(VIII)

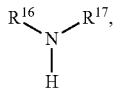

wherein $R^{16}$ and $R^{17}$ each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus the diarylamine may contain at least two nitrogen atoms wherein at least one nitrogen atom has two aryl groups attached thereto, e.g. as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenylamine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyldiphenylamine; p-oriented styrenated diphenylamine; mixed butyloctyldiphenylamine; and mixed octylstyryldiphenylamine.

Examples of commercially available diarylamines include, for example, diarylamines available under the trade name IRGANOX® from Ciba Specialty Chemicals; NAUGALUBE® from Crompton Corporation; GOODRITE® from BF Goodrich Specialty Chemicals; VANLUBE® from R. T. Vanderbilt Company Inc.

Another class of aminic antioxidants includes phenothiazine or alkylated phenothiazine having the chemical formula (IX)

(IX)

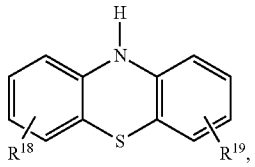

wherein $R^{18}$ is a linear or branched $C_{1-24}$-alkyl, aryl, heteroalkyl or alkylaryl group and $R^{19}$ is hydrogen or a linear or branched $C_{1-24}$-alkyl, heteroalkyl, or alkylaryl group. Alkylated phenothiazine may be selected from the group consisting of monotetradecylphenothiazine, ditetradecylphenothiazine, monodecylphenothiazine, didecylphenothiazine, monononylphenothiazine, dinonylphenothiazine, monoctylphenothiazine, dioctylphenothiazine, monobutylphenothiazine, dibutylphenothiazine, monostyrylphenothiazine, distyrylphenothiazine, butyloctylphenothiazine, and styryloctylphenothiazine.

The hindered phenol may be of the formula (X):

(X)

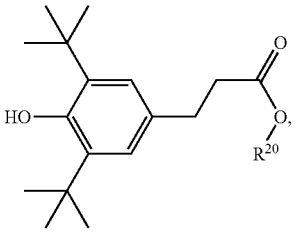

wherein $R^{20}$ denotes an alkyl group having 4 to16 carbon atoms, or the hindered phenol is bis-2',6'-di-tert-butylphenol. Preferred alkyl groups are butyl, ethylhexyl, iso-octyl, isostearyl and stearyl. A particularly preferred hindered phenol is available from R.T. Vanderbilt Company, Inc. as Vanlube® BHC (Iso-octyl-3-(3,5-di-tert-butyl-4-hydroxyphenyl) propionate) also known as butyl hydroxy-hydrocinnamate. Other hindered phenols may include oil-soluble non-sulfur phenolics, including but not limited to those described in U.S. Pat. No. 5,772,921, incorporated herein by reference.

Non-limiting examples of sterically hindered phenols include, but are not limited to, 2,6-di-tert-butylphenol, 2,6 di-tert-butyl methylphenol, 4-ethyl-2,6-di-tert-butylphenol, 4-propyl-2,6-di-tert-butylphenol, 4-butyl-2,6-di-tert-butyl-phenol, 4-pentyl-2,6-di-tert-butylphenol, 4-hexyl-2,6-di-tert-butylphenol, 4-heptyl-2,6-di-tert-butylphenol, 4-(2-ethylhexyl)-2,6-di-tert-butyl-phenol, 4-octyl-2,6-di-tert-butylphenol, 4-nonyl-2,6-di-tert-butylphenol, 4-decyl-2,6-di-tert-butylphenol, 4-undecyl-2,6-di-tert-butylphenol, 4-dodecyl-2,6-di-tert-butylphenol, methylene bridged sterically hindered phenols including but not limited to 4,4-methylenebis(6-tert-butyl-o-cresol), 4,4-methylenebis(2-tert-amyl-o-cresol), 2,2-methylenebis(4-methyl-6 tert-butylphenol, 4,4-methylene-bis(2,6-di-tert-butylphenol) and mixtures thereof as described in US Publication No. 2004/0266630.

Ashless dithiocarbamates as part of the antioxidant system comprise:

(i) Ashless Bisdithiocarbamate

The bisdithiocarbamates of formula (XI) are known compounds described in U.S. Pat. No. 4,648,985, incorporated herein by reference:

(XI)

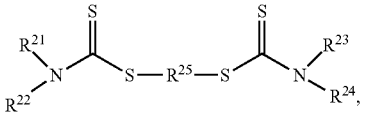

The compounds are characterized by $R^{21}$, $R^{22}$, $R^{23}$ and $R^{24}$ which are the same or different and are hydrocarbyl groups having 1 to 13 carbon atoms. Embodiments for the present invention include bisdithiocarbamates wherein $R^{21}$, $R^{22}$, $R^{23}$ and $R^{24}$ are the same or different and are branched or straight chain alkyl groups having 1 to 8 carbon atoms. $R^{25}$ is an aliphatic group such as straight and branched alkylene groups containing 1 to 8 carbons.

A preferred ashless dithiocarbamate is methylene-bis-dialkyldithiocarbamate, where alkyl groups contain 3 to 16 carbon atoms, and is available commercially under the tradename VANLUBE® 7723 from R.T. Vanderbilt Company, Inc.

The ashless dialkyldithiocarbamates include compounds that are soluble or dispersable in the additive package. It is also preferred that the ashless dialkyldithiocarbamate be of low volatility, preferably having a molecular weight greater than 250 daltons, most preferably having a molecular weight greater than 400 daltons. Examples of ashless dithiocarbamates that may be used include, but are not limited to, methylenebis(dialkyldithiocarbamate), ethylenebis(dialkyldithiocarbamate), isobutyl disulfide-2,2'-bis(dialkyldithiocarbamate), hydroxyalkyl substituted dialkyldithiocarbamates, dithiocarbamates prepared from unsaturated compounds, dithiocarbamates prepared from norbornylene, and dithiocarbamates prepared from epoxides, where the alkyl groups of the dialkyldithiocarbamate can preferably have from 1 to 16 carbon atoms. Examples of dialkyldithiocarbamates that may be used are disclosed in the following patents: U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Examples of preferred ashless dithiocarbamates are: Methylenebis(dibutyldithiocarbamate), Ethylenebis(dibutyldithiocarbamate), Isobutyl disulfide-2,2'-bis(dibutyldithiocarbamate), Dibutyl-N,N-dibutyl-(dithiocarbamyl)succinate, 2-hydroxypropyl dibutyldithiocarbamate, Butyl (dibutyldithiocarbamyl)acetate, and S-carbomethoxy-ethyl-N,N-dibutyl dithiocarbamate. The most preferred ashless dithiocarbamate is methylenebis(dibutyldithiocarbamate).

(ii) Ashless Dithiocarbamate Ester (XII)

(XII)

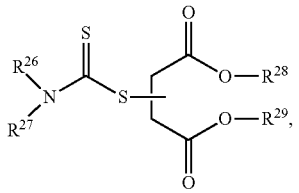

The compounds of formula XII are characterized by groups $R^{26}$, $R^{27}$, $R^{28}$ and $R^{29}$ which are the same or different and are hydrocarbyl groups having 1 to 13 carbon atoms. VANLUBE® 732 (dithiocarbamate derivative) and VANLUBE® 981 (dithiocarbamate derivative) are commercially available from R.T. Vanderbilt Company, Inc.

Pour point depressants, otherwise known as lube oil flow improvers, lower the minimum temperature at which the fluid will flow or can be poured. Such additives are well known. Non-limiting examples of pour point depressant additives which improve the low temperature fluidity of the fluid are about C8 to about C18 dialkyl fumarate/vinyl acetate copolymers, polyalkylmethacrylates, such as Viscoplex® 1-333, and the like.

A widespread class of commercial VI improvers is that of hydrogenated styrene-diene copolymers (HSDs). These HSDs may be present both in the form of $(\text{—B-A})_n$ stars (U.S. Pat. No. 4,116,917 to Shell Oil Company) and in the form of A-B diblock and A-B-A triblock copolymers (U.S. Pat. No. 3,772,196 and U.S. Pat. No. 4,788,316 to Shell Oil Company). In these formulae, A is a block of hydrogenated polyisoprene and B is a divinylbenzene-crosslinked polystyrene ring or a block of polystyrene. The Infineum SV series from Infineum International Ltd., Abingdon, UK includes products of this type. Typical star polymers are Infineum SV 200, 250 and 260. Infineum SV 150 is a diblock polymer.

In addition, the lubricant oil compositions detailed here may also be present in mixtures with conventional VI improvers. These include especially hydrogenated styrene-diene copolymers (HSDs, U.S. Pat. No. 4,116,917, U.S. Pat. No. 3,772,196 and U.S. Pat. No. 4,788,316 to Shell Oil Company), especially based on butadiene and isoprene, and also olefin copolymers (OCPs, K. Marsden: "Literature Review of OCP Viscosity Modifiers", Lubrication Science 1 (1988), 265).

Compilations of VI improvers and pour point improvers for lubricant oils, especially motor oils, are detailed, for example, in T. Mang, W. Dresel (eds.): "Lubricants and Lubrication", Wiley-VCH, Weinheim 2001: R. M. Mortier, S. T. Orszulik (eds.): "Chemistry and Technology of Lubricants", Blackie Academic & Professional, London 1992; or J. Bartz: "Additive für Schmierstoffe", Expert-Verlag, Renningen-Malmsheim 1994.

The inventive composition preferably comprises at least one lubricating oil or base oil.

The lubricant oils include especially mineral oils, synthetic oils and natural oils.

Mineral oils are known per se and commercially available. They are generally obtained from mineral oil or crude oil by distillation and/or refining and optionally further purification and finishing processes, the term "mineral oil"

including in particular the higher-boiling fractions of crude or mineral oil. In general, the boiling point of mineral oil is higher than 200° C., preferably higher than 300° C., at 5000 Pa. The production by low-temperature carbonization of shale oil, coking of bituminous coal, distillation of brown coal with exclusion of air, and also hydrogenation of bituminous or brown coal is likewise possible. Accordingly, mineral oils have, depending on their origin, different proportions of aromatic, cyclic, branched and linear hydrocarbons.

In general, a distinction is drawn between paraffin-base, naphthenic and aromatic fractions in crude oils or mineral oils, in which the term "paraffin-base fraction" represents longer-chain or highly branched isoalkanes, and "naphthenic fraction" represents cycloalkanes. In addition, mineral oils, depending on their origin and finishing, have different fractions of n-alkanes, isoalkanes having a low degree of branching, known as mono-methyl-branched paraffins, and compounds having heteroatoms, in particular O, N and/or S, to which a degree of polar properties are attributed. However, the assignment is difficult, since individual alkane molecules may have both long-chain branched groups and cycloalkane radicals, and aromatic parts. For the purposes of the present invention, the assignment can be effected to DIN 51 378, for example. Polar fractions can also be determined to ASTM D 2007.

The proportion of n-alkanes in preferred mineral oils is less than 3% by weight, the fraction of O-, N- and/or S-containing compounds less than 6% by weight. The fraction of the aromatics and of the mono-methyl-branched paraffins is generally in each case in the range from 0 to 40% by weight. In one interesting aspect, mineral oil comprises mainly naphthenic and paraffin-base alkanes which have generally more than 13, preferably more than 18 and most preferably more than 20 carbon atoms. The fraction of these compounds is generally 60% by weight, preferably 80% by weight, without any intention that this should impose a restriction. A preferred mineral oil contains 0.5 to 30% by weight of aromatic fractions, 15 to 40% by weight of naphthenic fractions, 35 to 80% by weight of paraffin-base fractions, up to 3% by weight of n-alkanes and 0.05 to 5% by weight of polar compounds, based in each case on the total weight of the mineral oil.

An analysis of particularly preferred mineral oils, which was effected by means of conventional processes such as urea separation and liquid chromatography on silica gel, shows, for example, the following constituents, the percentages relating to the total weight of the particular mineral oil used:

n-alkanes having approx. 18 to 31 carbon atoms:
0.7-1.0%,
slightly branched alkanes having 18 to 31 carbon atoms:
1.0-8.0%,
aromatics having 14 to 32 carbon atoms:
0.4-10.7%,
iso- and cycloalkanes having 20 to 32 carbon atoms:
60.7-82.4%,
polar compounds:
0.1-0.8%,
loss:
6.9-19.4%.

An improved class of mineral oils (reduced sulfur content, reduced nitrogen content, higher viscosity index, lower pour point) results from hydrogen treatment of the mineral oils (hydroisomerization, hydrocracking, hydrotreatment, hydrofinishing). In the presence of hydrogen, this essentially reduces aromatic components and builds up naphthenic components.

Valuable information with regard to the analysis of mineral oils and a list of mineral oils which have a different composition can be found, for example, in Ullmann's Encyclopedia of Industrial Chemistry, 5th Edition on CD-ROM, 1997, under "lubricants and related products".

Synthetic oils include organic esters, for example diesters and polyesters, polyalkylene glycols, polyethers, synthetic hydrocarbons, especially polyolefins, among which preference is given to polyalphaolefins (PAOs), silicone oils and perfluoroalkyl ethers. In addition, it is possible to use synthetic base oils originating from gas to liquid (GTL), coal to liquid (CTL) or biomass to liquid (BTL) processes. They are usually somewhat more expensive than the mineral oils, but have advantages with regard to their performance.

GTL oils may be oils from Fischer-Tropsch-synthesised hydrocarbons made from synthesis gas containing hydrogen and carbon monoxide using a Fischer-Tropsch catalyst. These hydrocarbons typically require further processing in order to be useful as base oil. For example, they may, by methods known in the art be hydroisomerized, dewaxed, or hydroisomerized and dewaxed.

Natural oils are animal or vegetable oils, for example neatsfoot oils or jojoba oils.

Base oils for lubricant oil formulations are divided into groups according to API (American Petroleum Institute). Mineral oils are divided into group I (non-hydrogen-treated; sulfur content >0.03 wt. % and/or 90 wt. % saturates, viscosity index 80-120) and, depending on the degree of saturation, sulfur content and viscosity index, into groups II (hydrogen-treated; sulfur content <0.03 wt. %, and >90 wt. % saturates, viscosity index 80-120) and III (hydrogen-treated; sulfur content <0.03 wt. %, and >90 wt. % saturates, viscosity index >120). PAOs correspond to group IV. All other base oils are encompassed in group V.

The lubricant oils (base oils) used may especially be oils having a viscosity in the range from 3 $mm^2/s$ to 100 $mm^2/s$, more preferably 13 $mm^2/s$ to 65 $mm^2/s$, measured at 40° C. to ASTM 445. The use of these base oils allows surprising advantages to be achieved with regard to energy requirement.

These lubricant oils may also be used as mixtures and are in many cases commercially available.

Process for Preparing

The inventive polymers can be prepared in various ways. A preferred process consists in the free-radical copolymerization, which is known per se.

The copolymers of this invention may be prepared by processes comprising reacting, in the presence of a free radical initiator, monomers (a) to (e), optionally in the presence of a chain transfer agent. The monomers may be reacted concurrently.

For instance, these polymers can be prepared especially by free-radical polymerization, and also related processes for controlled free-radical polymerization, for example ATRP (=Atom Transfer Radical Polymerization) or RAFT (=Reversible Addition Fragmentation Chain Transfer).

Customary free-radical polymerization is explained, inter alia, in Ullmanns's Encyclopedia of Industrial Chemistry, Sixth Edition. In general, a polymerization initiator and a chain transferer are used for this purpose.

The usable initiators include the azo initiators well known in the technical field, such as AIBN and 1,1-azobiscyclohexanecarbonitrile, and also peroxy compounds such as methyl-ethyl-ketone peroxide, acetylacetone peroxide, dilauryl peroxide, tert-butyl per-2-ethylhexanoate, ketone peroxide, tert-butyl peroctoate, methyl isobutyl ketone peroxide, cyclohexanone peroxide, dibenzoyl peroxide, tert-butyl peroxybenzoate, tert-butyl peroxyisopropylcarbonate, 2,5-bis(2-ethylhexanoylperoxy)-2,5-dimethylhexane, tert-butyl peroxy-2-ethylhexanoate, tert-butyl-peroxy-3,5,5-trimethylhexanoate, dicumyl peroxide, 1,1-bis(tert-butylperoxy)cyclohexane, 1,1-bis(tert-butylperoxy)-3,3,5-trimethylcyclohexane, cumyl hydroperoxide, tert-butyl hydroperoxide, bis(4-tert-butylcyclohexyl) peroxydicarbonate, mixtures of two or more of the aforementioned compounds with one another, and also mixtures of the aforementioned compounds with compounds which have not been mentioned and can likewise form free radicals. Suitable chain transferers are especially oil-soluble mercaptans, for example n-dodecyl mercaptan or 2-mercaptoethanol, or else chain transferers from the class of the terpenes, for example terpinolene.

The ATRP process is known per se. It is assumed that this is a "living" free-radical polymerization, without any intention that this should restrict the description of the mechanism. In these processes, a transition metal compound is reacted with a compound which has a transferable atom group. This transfers the transferable atom group to the transition metal compound, which oxidizes the metal. This reaction forms a radical which adds onto ethylenic groups. However, the transfer of the atom group to the transition metal compound is reversible, so that the atom group is transferred back to the growing polymer chain, which forms a controlled polymerization system. The structure of the polymer, the molecular weight and the molecular weight distribution can be controlled correspondingly.

This reaction is described, for example, by J-S. Wang, et al., J. Am. Chem. Soc., vol. 117, p. 5614-5615 (1995), by Matyjaszewski, Macromolecules, vol. 28, p. 7901-7910 (1995). In addition, the patent applications WO 96/30421, WO 97/47661, WO 97/18247, WO 98/40415 and WO 99/10387, disclose variants of the ATRP explained above.

In addition, the inventive polymers may be obtained, for example, also via RAFT methods. This process is presented in detail, for example, in WO 98/01478 and WO 2004/083169.

The polymerization may be carried out at standard pressure, reduced pressure or elevated pressure. The polymerization temperature too is uncritical. However, it is generally in the range of −20° C. to 200° C., preferably 50° C. to 150° C. and more preferably 80° C. to 130° C.

The polymerization can be performed with or without solvent. The term solvent should be understood here in a broad sense. The solvent is selected according to the polarity of the monomers used, and it is preferable to use 100N oil, relatively light gas oil and/or aromatic hydrocarbons, for example toluene or xylene.

Preferred lubricant oil compositions have a viscosity, measured at 40° C. to ASTM D 445, in the range of 10 to 120 $mm^2/s$, more preferably in the range of 22 to 100 $mm^2/s$. The kinematic viscosity $KV_{100}$ measured at 100° C. is preferably at least 5.5 $mm^2/s$, more preferably at least 5.6 $mm^2/s$ and most preferably at least 5.8 $mm^2/s$.

In a particular aspect of the present invention, preferred lubricant oil compositions have a viscosity index determined to ASTM D 2270 in the range of 100 to 400, more preferably in the range of 150 to 350 and most preferably in the range of 175 to 275.

Lubricant oil compositions which are additionally of particular interest are those which have a high-temperature high-shear viscosity HTHS measured at 150° C. of at least 2.3 mPas, more preferably at least 2.6 mPas. The high-temperature high-shear viscosity HTHS measured at 100° C. is preferably at most 10 mPas, more preferably at most 7 mPas and most preferably at most 5.5 mPas. The difference between the high-temperature high-shear viscosities HTHS measured at 100° C. and 150° C., HTHS100-HTHS150, is preferably at most 4 mPas, more preferably at most 3.3 mPas and most preferably at most 2.5 mPas. The ratio of high-temperature high-shear viscosity at 100° C. ($HTHS_{100}$) to high-temperature high-shear viscosity at 150° C. ($HTHS_{150}$), $HTHS_{100}/HTHS_{150}$, is preferably at most 2.0, more preferably at most 1.9. The high-temperature high-shear viscosity HTHS can be measured at the particular temperature to ASTM D4683.

In an appropriate modification, the permanent shear stability index (PSSI) to ASTM D2603 Ref. B (ultrasound treatment for 12.5 minutes) may be less than or equal to 36, more preferably less than or equal to 20. Advantageously, it is also possible to obtain lubricant oil compositions which have a permanent shear stability index (PSSI) to DIN 51381 (30 cycles of a Bosch pump) of at most 5, preferably at most 2 and most preferably at most 1.

The fuel saving (compared to 15W-40 reference motor oil RL 191) for use in passenger motor vehicles is determined in Europe generally according to test method CEC L 54-T-96 ("Mercedes-Benz M111 Fuel Economy Test"; CEC=Coordinating European Council for Development of Performance Tests for Transportation Fuels, Lubricants and Other Fluids). More recent results (K. Hedrich, M. A. Mueller, M. Fischer: "Evaluation of Ashless, Phosphorus Free and Low Sulfur Polymeric Additives that Improve the Performance of Fuel Efficient Engine Oils" in Conference Proceedings of the International Tribology Conference (ITC 2005) at Kobe/Japan; K. Hedrich, G. Renner: "New Challenge of VI Improver for Next Generation Engine Oils" in Conference Proceedings of the International Tribology Conference (ITC 2000) at Nagasaki/Japan) show that another test method ("RohMax test") can also afford comparable results. Here, not a 2.0 L gasoline engine but rather a 1.9 L diesel engine (81 kW at 4150 rpm) is used. The setup of this engine corresponds essentially to the setup described in the test method CEC L-78-T-99 ("Volkswagen Turbocharged DI Diesel Piston Cleanliness and Ring Sticking Evaluation"). Exact maintenance of the oil temperature according to CEC L-54-T-96 necessitates additional cooling in the setup. Common features and differences of CEC L-54-T-96 and of the "RohMax test" are as follows:

It is common knowledge in the industry that lower viscosity oils tend to have better fuel economy than higher viscosity oils. Unfortunately, lower viscosity oils tend to have thinner oil films which offer less wear protection than thick oils. It is also well known in the industry that fuel economy can be improved by increasing the level of molybdenum based friction modifier in the engine oil. However, adding too much molybdenum to the engine oil may cause problems such as bearing corrosion and turbocharger related coking deposits.

To meet the new government Corporate Average Fuel Economy (CAFE) fuel economy standards, OEMS are now building smaller engines with turbochargers. These small high-performance turbocharged engines subject the engine oil to very high temperatures. Turbochargers have been found to cook the engine oil, especially after a quick engine shut down. When this occurs, the oil tends to form coking deposits on key parts of the turbocharger. Turbocharger failure is known to occur if sufficient deposits are formed. It is well known in the industry that high molybdenum containing engine oils have a greater tendency to form turbocharger related coking deposits than low molybdenum containing engine oils.

Thus the engine oil industry is frustrated in its attempts to meet these new tougher CAFE fuel economy standards by formulating thin, high molybdenum engine oils. The engine oil formulator finds himself in the situation of having to thread the eye of the needle with the proper balance of base oil and friction modifiers to achieve the desired fuel economy performance without causing harm to the engine or turbocharger. The inventive Experimental Oil was specifically formulated to minimize both turbocharger related coking deposits and copper corrosion related bearing wear associated with certain high molybdenum containing engine oils while offering excellent fuel economy performance across a broad temperature range versus a commercial high molybdenum containing engine oil purchased off the shelf.

Experimental Part

EXAMPLES

A fully formulated lubricant composition was prepared using Group III base oil. Formulation 1 contained 0.35% by weight of ZDDP sufficient to deliver 250 ppm phosphorus to the finished oil, 4.2% by weight of a dispersant polyalkyl (meth)acrylate Polymer 1, and 3.0% by weight of a polyisobutylene (PIB) based dispersant additive C-9268 from Infineum. Sufficient molybdenum was added to the oil from two different molybdenum sources (Molyvan® 855 molybdate ester and Molyvan® 822 molybdenum dialkyldithiocarbamat) such that the molybdenum content was roughly 700 ppm.

Formulation 1 further contained an antioxidant system including: Vanlube® 961 (mixed octylated and butylated diphenylamines); Vanlube® 7723 methylene bis dibutyldithiocarbamate; and Vanlube® BHC iso-octyl-3-(3,5-di-tert-butyl-4-hydroxyphenyl)prioprionate; as well as: 300 TBN (total base number) calcium sulfonate, Viscoplex® 1-333 poly(meth)acrylate pour point depressant, and Vanlube® 887E tolutriazole corrosion inhibitor.

A pour point depressant (PPD) is an additive that reduces oil low temperature viscosity by controlling wax crystallization phenomenon in lubricants.

Polymer 1:

| | C1-5-alkyl methacrylate [weight-%] | C6-15-alkyl methacrylate [weight-%] | C16-40-alkyl methacrylate [weight-%] | vinyl monomers [weight-%] | N-dispersant monomer [weight-%] |
|---|---|---|---|---|---|
| Polymer 1 | 13 | 84 | 0 | 0 | 3 |

The comparator oil was commercial 0W-20 motor oil purchased of the shelf that contained 850 ppm phosphorus and 766 ppm molybdenum (Comparative Formulation 1).

| | Formulation 1 | Comparative Formulation 1 |
|---|---|---|
| | SAE Grade | |
| | 0W-20 | 0W-20 |
| Dispersant [% by weight] | 3.0 | unknown |
| Polymer 1 [% by weight] | 4.2 | unknown |

-continued

| | Formulation 1 | Comparative Formulation 1 |
|---|---|---|
| | SAE Grade | |
| | 0W-20 | 0W-20 |
| Molybdenum [ppm] | 701 | 766 |
| Phosphorus [ppm] | 234 | 740 |

(1) Kinematic Viscosity and HTHS Results

Thin oils are known to have better fuel economy than thick oils. In order to maximize the fuel economy benefit of our experimental fully formulated engine oil, the oil was specifically formulated to have low High Temperature High Shear (HTHS) and kinematic viscosity while still meeting all of the SAE J300 requirements. The J300 is an internationally recognized document that defines the rheological limits for classifying engine oils. The kinematic and HTHS viscosity data for the Formulation 1 and the Comparative Formulation 1 is shown below, see Table 1. Both oils are SAE grade 0W-20. The kinematic viscosity data for the Formulation 1 shows that it has lower kinematic viscosity at −5° C., 20° C. and 40° C. versus the Comparative Formulation 1. It also has lower HTHS values at 100° C. and 150° C. than the Comparative Formulation 1.

TABLE 1

HTHS and Kinematic Viscosity Results for Formulation 1 and Comparative Formulation 1

| | SAE class J300 | | |
|---|---|---|---|
| Oil formulation code | Comparative Formulation 1 | 0W-20 Formulation 1 | 0W-20 test method |
| chemical - physical data and cold temperature properties | | | |
| Viscosity @ −5° C. [$mm^2/s$] | 430.60 | 406.70 | ASTM D 445 |

TABLE 1-continued

HTHS and Kinematic Viscosity Results for Formulation 1 and Comparative Formulation 1

| | SAE class J300 | | |
|---|---|---|---|
| Oil formulation code | Comparative Formulation 1 | 0W-20 Formulation 1 | 0W-20 test method |
| Viscosity @ 20° C. [$mm^2/s$] | 96.10 | 93.11 | |
| Viscosity @ 40° C. [$mm^2/s$] | 40.84 | 40.20 | |
| Viscosity @ 100° C.[$mm^2/s$] | 8.56 | 8.66 | |

TABLE 1-continued

HTHS and Kinematic Viscosity Results for Formulation 1 and Comparative Formulation 1

| Oil formulation code | SAE class J300 Comparative Formulation 1 | 0W-20 Formulation 1 | 0W-20 test method |
|---|---|---|---|
| Viscosity @ 120° C. [$mm^2/s$] | 6.12 | 6.23 | |
| Viscosity Index | 194 | 203 | ASTM D 2270 |
| CCS at −30° C. in mPas | 3233 | 2874 | ASTM D 5293 |
| CCS at −35° C. in mPas | 5968 | 5200 | |
| Pour Point [° C.] | <−51.2 | <−50.2 | ASTM D 6829 |
| HTHS at 100° C. in mPas | 5.8 | 5.5 | ASTM D 4683 |
| HTHS at 150° C. in mPas | 2.7 | 2.6 | ASTM D 6616 |

(2) TEOST 33C

The TEOST 33C is a high temperature oxidation bench test used by the industry for measuring the turbocharger related coking deposit tendencies of engine oil. High molybdenum and high phosphorus engine oils have traditionally performed poorly in this bench test. The inventive Formulation 1 contains a high level of molybdenum for good fuel economy and a reduced level of phosphorus to lower TEOST 33C deposits. The Comparative Formulation 1 has a typical level of phosphorus as specified by GF-5, the current passenger car motor oil specification. Both test oils were run in the TEOST 33C per ASTM specification D-6335. The test results for the Formulation 1 show it having a significantly reduced level of deposits versus the Comparative Formulation 1, see table 2. The Comparator oil is a commercially available oil purchased off the shelf with high molybdenum and high phosphorus content.

TABLE 2

TEOST 33C Deposit Results for the Formulation 1 and Comparative Formulation 1

| | Formulation 1 | Comparative Formulation 1 |
|---|---|---|
| TEOST 33C Deposit [mg] | 60.8 | 86.4 |
| Molybdenum [ppm] | 700 | 766 |
| Phosphorus [ppm] | 250 | 740 |

(3) Copper Corrosion

Corrosion is another area of concern for high molybdenum containing engine oils. Molybdenum dithiocarbamate (MoDTC) is one of the more common molybdenum containing friction modifiers added to motor oil. It is also well known to those in the industry that MoDTC can cause a high level of bearing related copper corrosion. A high level of copper corrosion can cause the engine to undergo expensive repair or have a dramatically shortened life expectancy. The High Temperature Corrosion Bench Test (HTCBT) is used by the industry to measure lead, copper and tin corrosion tendencies of motor oil. The copper corrosion tendency of the Formulation 1 and Comparative Formulation 1 was determined using the HTCBT, per the ASTM specification D-6594. The HTCBT test results, run in duplicate, show the Formulation 1 having several orders of magnitude less copper corrosion than the Comparative Formulation 1, see Table 3.

TABLE 3

HTCBT Copper Test Results for Formulation 1 and Comparative Formulation 1

| | Formulation 1 | Comparative Formulation 1 |
|---|---|---|
| Copper Corrosion [ppm] | 17/17 | 226/300 |

(4) Sequence VI D and Evonik Engine Test Results Summary

GF-5 is the current Passenger Car Motor Oil (PCMO) performance specification for gasoline fired engines. This specification sets the minimum performance level for motor oil and in particular for fuel economy. The Sequence VID engine test is used to measure fuel economy and is a key test in the GF-5 specification. This engine test measures initial fuel economy, FEI 1, and fuel economy retention, FEI 2, parameters. Based on these two parameters, the FEI Sum is calculated by adding FEI 1 and FEI 2.

The Formulation 1, SAE grade 1W-20 as defined by J300, was run in an ASTM calibrated Sequence VID engine test at an independent test according to ASTM procedure D-7589. The Sequence VID engine test results for the Formulation 1 show it easily exceeding the GF-5, Sequence VID engine test specification for fuel economy, see Table 4, and thereby having excellent fuel economy.

TABLE 4

Sequence VID Engine Test Results for Formulation 1

| | GF-5 Specification | Formulation 1 |
|---|---|---|
| FEI 1 | 1.4 | 1.93 |
| FEI 2 | 1.2 | 1.52 |
| FEI Sum (Sum of FEI 1 + FEI 2) | 2.6 | 3.45 |

A proprietary in-house fuel economy engine test was developed using the VW TDI engine and a modified CEC M111 (PL-054) test procedure that permits fuel consumption measurements. The test consists of four engine tests, each run at a different temperature. The four test temperatures were selected to duplicate two common driving conditions. The test conditions and temperatures are urban driving at 20° C. and 33° C. and severe urban driving at 70° C. and 88° C. The relative fuel economy performance of the test oils is determined by first running a Base Line Oil and recording its fuel consumption. Then the Comparative Formulation 1 and Formulation Tare run immediately after the Base Line Oil and their fuel consumptions measured. Both test oils were run three times. The percent increase or decrease in fuel consumption versus the Base Line Oil is then calculated. For the Formulation 1 to show fuel economy improvement versus the Comparative Formulation 1, it must consume less fuel than the Comparative Formulation 1. With this unique engine test, research scientists can now create a fuel economy versus temperature performance profile.

The Formulation 1 was run in the VW TDI engine test and compared to a similar, high molybdenum, off the shelf commercial oil. Both test oils were 0W-20 grade oils as defined by J-300 and were run three times at all four test temperatures. The data for the Experimental and Comparator Oils is shown below, Tables 5A, 5B, 5C and 5D.

The VWTDI engine test data show the Formulation 1 delivering lower fuel consumption, better fuel economy, than the Comparative Formulation 1 at all four test temperatures. At the urban test conditions, 20° C. and 33° C., the Formulation 1 delivered a two fold drop in fuel consumption as measured on a percentage basis versus the Comparative Formulation 1. As the test temperature increased, the Formulation 1 delivered better fuel consumption than the Comparative Formulation 1, but at a lower level.

In summary, the Formulation 1 delivered significantly better fuel economy than what is required for GF-5 as evidenced by the excellent Sequence VID engine test results. Furthermore, the VWTDI engine test data showed the Formulation 1 delivering lower fuel consumption at all four test temperatures with the biggest improvement in fuel economy occurring at the lowest temperatures, 20° C. and 33° C.

TABLE 5A

VW TDI Engine Test Percent Drop in Fuel Consumption at 20° C.

| | Comparative Formulation 1 | Formulation 1 |
|---|---|---|
| Run 1 | −1.63% | −3.56% |
| Run 2 | −1.84% | −2.88% |
| Run 3 | −1.30% | −3.35% |
| Average | −1.59% | −3.26% |

TABLE 5B

VW TDI Engine Test Percent Drop in Fuel Consumption Data at 33° C.

| | Comparative Formulation 1 | Formulation 1 |
|---|---|---|
| Run 1 | −1.63% | −3.56% |
| Run 2 | −1.84% | −2.88% |
| Run 3 | −1.30% | −3.35% |
| Average | −1.62% | −3.46% |

TABLE 5C

VW TDI Engine Test Percent Drop in Fuel Consumption Data at 70° C.

| | Comparative Formulation 1 | Formulation 1 |
|---|---|---|
| Run 1 | +0.06% | −2.11% |
| Run 2 | −0.75% | −3.34% |
| Run 3 | +0.09% | −3.00% |
| Average | −0.20% | −2.82% |

TABLE 5D

VW TDI Engine Test Percent Drop in Fuel Consumption Data at 88° C.

| | Comparative Formulation 1 | Formulation 1 |
|---|---|---|
| Run 1 | −0.81 | −1.10 |
| Run 2 | −0.72 | −1.12 |
| Run 3 | −0.55 | −0.63 |
| Average | −0.69 | −0.95 |

In order to demonstrate the synergistic fuel efficiency effect of the inventive formulation, in particular a combination with the poly(meth)acrylate VI improver and the antioxidant/antiwear system, a Comparative Formulation 2 was prepared. Such Comparative Formulation 2 essentially corresponds in its components, except for the absence of the poly(meth)acrylate VI improver Polymer 1. The formulations are set out in Table 6 below, with comparative data in Table 7:

TABLE 6

| | Description | Comparative Formulation 2 | Formulation 1 |
|---|---|---|---|
| Dispersant | | | |
| C-9268 | 2225 Mwt. PIB based dispersant | 5.00 | 3.00 |
| Detergent | | | |
| C-313 | 300 TBN Ca sulfonate | 2.00 | 2.00 |
| Antioxidant/ Antiwear System | | — | — |
| | Vanlube ® 961<br>Vanlube ® 7723<br>Vanlube ® BHC<br>Vanlube ® 887E<br>Molyvan ® 855<br>Molyvan ® 822<br>Oloa-262 (ZDDP) | 3.95 | 3.95 |
| VI Improver | | | |
| Polymer 1 | dispersant PAMA | — | 4.20 |
| Lz-7070D | OCP | 6.8 | — |
| PPD | | | 13 |
| VISCOPLEX ® 1-333 | PAMA PPD | 0.30 | 0.30 |
| Base Oil | | | |
| VHVI-4-2010 | | 60.55 | 83.35 |
| VHVI-2-2-010 | | 21.4 | 3.2 |
| Total | | 100.00 | 100.00 |

Mwt.: molecular weight
Lz: Lubrizol

TABLE 7

| | | Comparative Formulation 2 | Formulation 1 | |
|---|---|---|---|---|
| Viscosity @ −5° C. | $mm^2/s$ | 109.5 | 93.11 | ASTM D-445 |
| Viscosity @ 20° C. | $mm^2/s$ | 44.83 | 40.20 | |
| HTHS @ 100° C. | mPas | 5.82 | 5.5 | ASTM D 4683 |
| Noack Test 1 h @ 250° C. | % | 20.6 | 13.2 | |

The Comparative Formulation 2 clearly highlights the viscometric advantages associated with the use of the dispersant PAMA and the antioxidant/antiwear system in Formulation 1. It can be seen that the formulation without the dispersant PAMA must use additional dispersant for equivalent performance which results in a different balance of the base oil system. The outcome is that the formulation with the dispersant PAMA (Formulation 1) can be optimized for the lower viscosity at 40° C., the viscosity at 20° C. and also at −5° C. Additionally, the HTHS viscosity at 100° C. is similarly lower.

Studies have shown that Fuel Economy can be correlated to the viscosity at 40° C., the viscosity at 20° C. and HTHS at 100° C. In conclusion, the formulation utilizing the dispersant PAMA and the proprietary antioxidant/antiwear system (Formulation 1) has optimum viscometric properties and will result in superior fuel economy than the Comparative Formulation 2.

It should be further noted that the Comparative Formulation 2 has very poor Noack Volatility results due to the revised base oil balance that the OCP viscosity index improver (VII) and higher level of dispersant demand compared to the formulation with dispersant PAMA.

The invention claimed is:

1. A lubricating composition comprising base oil, and an additive comprising:

(A) about 4.2% by weight, of one or more polyalkyl (meth)acrylate(s) comprising monomer units of:

(a) about 13% by weight of one or more methacrylate compounds having 1 to 5 carbon atoms;

(b) about 84% by weight, of one or more methacrylate compounds having 6 to 15 carbon atoms; and (c) about 3% by weight of at least one N-dispersant monomer, wherein components (a) to (c) add up to 100% by weight;

(B) one or more organomolybdenum compound(s) at an amount which provides 500 ppm to 1000 ppm of Mo, said organomolybdenum compound comprising one or both of (a) the reaction product of about 1 mole of fatty oil, about 1.0 to 2.5 moles of diethanolamine and a molybdenum source sufficient to yield about 0.1 to 12.0 percent of molybdenum based on the weight of the complex at elevated temperatures, comprising at least some compounds having the structural formulae (VIa) or (VIb)

(VIa)

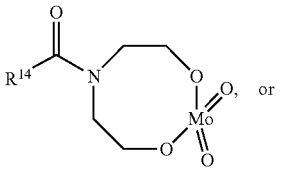

or (VIb)

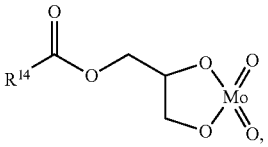

wherein $R^{14}$ represents a fatty oil residue, and (B) molybdenum dialkyldithiocarbamate;

(C) a phosphorus compound at an amount which provides 150 ppm to 500 ppm of P, said phosphorous compound being selected from the group consisting of zinc dialkyldithiophosphate (ZDDP) compositions that include one or more ZDDP compounds;

(D) 0.3% by weight to 6% by weight, of an antioxidant system, comprising (i) an alkylated diphenylamine, at about 0.1% by weight to 2.0% by weight;

(ii) iso-octyl-3-(3,5-di-tert-butyl-4-hydroxyphenyl) propionate, at about 0.1% by weight to 2.0% by weight; and (iii) methylene bis dibutyldithiocarbamate, at about 0.1% by weight to 2.0% by weight;

wherein the indicated weight percent of each of components (A) and (D) is relative to the sum of weight percent of all components of the lubricating composition, and wherein the sum of components (B), (C) and (D) add up to about 3.95% by weight of the sum of weight percent of all components of the lubricating composition.

2. The composition according to claim 1, wherein the N-dispersant monomer (c) is selected from the group consisting of N-vinylic monomers, (meth)acrylic esters, (meth) acrylic amides and (meth)acrylic imides.

3. The composition according to claim 1, wherein the N-dispersant monomer (c) is of the formula (IV)

(IV)

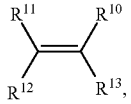

wherein $R^{10}$, $R^{11}$ and $R^{12}$ independently are H or a linear or branched alkyl group with 1 to 5 carbon atoms and $R^{13}$ is either a group C(Y)X—$R^{14}$ with X═O or X═NH and Y is (═O) or (═$NR^{15}$), where $R^{15}$ is an alkyl group with 1 to 8 carbon atoms or an aryl group, and $R^{14}$ represents a linear or branched alkyl group with 1 to 20 carbon atoms which is substituted by a group —$NR^{16}R^{17}$ wherein $R^{16}$ and $R^{17}$ independently represent H or a linear or branched alkyl group with 1 to 8 carbon atoms, or wherein $R^{16}$ and $R^{17}$ together with the nitrogen to which they are bound form a 4- to 8-membered saturated or unsaturated ring containing optionally one or more hetero atoms chosen from the group consisting of nitrogen, oxygen or sulfur, wherein said ring may be further substituted with alkyl or aryl groups, or $R^{13}$ is a group $NR^{18}R^{19}$, wherein $R^{18}$ and $R^{19}$ together with the nitrogen to which they are bound form a 4- to 8-membered saturated or unsaturated ring, containing at least one carbon atom as part of the ring which forms a double bond to a hetero atom chosen from the group consisting of nitrogen, oxygen or sulfur, wherein said ring may be further substituted with alkyl or aryl groups.

4. The composition according to claim 1, wherein the N-dispersant monomer (c) is selected from the group consisting of vinyl substituted nitrogen heterocyclic monomers, N-vinyl-substituted nitrogen heterocyclic monomers, dialkylaminoalkyl acrylate and methacrylate monomers, dialkylaminoalkyl acrylamide and methacrylamide monomers, N-tertiary alkyl acrylamides and corresponding methacrylamides, vinyl substituted amines, and N-vinyl lactams.

5. The composition according to claim 1, wherein the N-dispersant monomer (c) is selected from the group consisting of N-vinyl pyrrolidinone and N,N-dimethylaminoethyl methacrylate, N,N-dimethylaminopropyl methacrylamide.

6. The composition according to claim 1, wherein the fatty oil residue is a glyceryl ester of higher fatty acids containing at least 22 carbon atoms.

7. The composition according to claim 6, wherein the glyceryl ester is selected from the group consisting of vegetable oils and animal oils.

8. The composition according to claim 7, wherein the vegetable oil is derived from coconut, corn, cottonseed, linseed, peanut, soybean or sunflower seed.

9. The composition according to claim 7, wherein the animal fatty oil is tallow.

10. A lubricant composition comprising a base oil and an additive comprising:

(A) about 4.2% by weight of one or more polyalkyl(meth) acrylate(s) comprising monomer units of:

(a) about 13% by weight of one or more methacrylate compounds having 1 to 5 carbon atoms;

(b) about 84% by weight of one or more methacrylate compounds having 6 to 15 carbon atoms; and (c) about 3% by weight of at least one N-dispersant monomer, wherein components (a) to (c) add up to 100% by weight;

(B) one or more organomolybdenum compound(s) at an amount which provides 500 ppm to 1000 ppm of Mo, said organomolybdenum compound comprising one or both of (a) the reaction product of about 1 mole of fatty oil, about 1.0 to 2.5 moles of diethanolamine and a molybdenum source sufficient to yield about 0.1 to 12.0 percent of molybdenum based on the weight of the complex at elevated temperatures, comprising at least some compounds having the structural formulae (VIa) or (VIb)

(VIa)

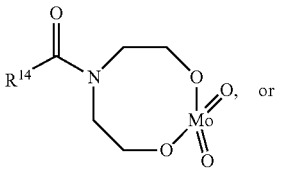

or (VIb)

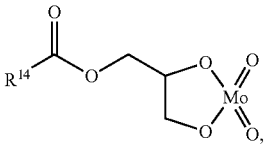

wherein $R^{14}$ represents a fatty oil residue, and (B) molybdenum dialkyldithiocarbamate;

(C) a phosphorus compound at an amount which provides 150 ppm to 500 ppm of P, said phosphorous compound being selected from the group consisting of zinc dialkyldithiophosphate (ZDDP) compositions that include one or more ZDDP compounds;

(D) about 3.0% by weight, of a dispersant;

(E) 0.3% by weight to 6.0% by weight, of an antioxidant system, which comprises one or more of (i) alkylated diphenylamine, at about 0.1% by weight to 2.0% by weight;

(ii) iso-octyl-3-(3,5-di-tert-butyl-4-hydroxyphenyl) propionate, at about 0.1% by weight to 2.0% by weight; and (iii) methylene bis dibutyldithiocarbamate, at about 0.1% by weight to 2.0% by weight;

(F) about 2.0% by weight of a metal detergent;

(G) 0% by weight to 3.0% by weight, of a corrosion inhibitor; and (H) about 0.3% by weight, of a pour point depressant;

wherein the indicated weight percent of each of components (A) and (D) to (H) is relative to the sum of weight percent of all components of the lubricating composition, and wherein the sum of components (B), (C) (E) and (G) add up to about 3.95% by weight of the sum of weight percent of all components of the lubricating composition.

11. The lubricant composition of claim 10, further comprising:

as the metal detergent, calcium sulfonate, as the dispersant, bis-succinimide dispersant, as the pour point depressant, a poly(meth)acrylate, and as the corrosion inhibitor, tolutriazole.

* * * * *